US009366253B2

(12) United States Patent
Hirata et al.

(10) Patent No.: US 9,366,253 B2
(45) Date of Patent: Jun. 14, 2016

(54) SCROLL COMPRESSOR AND PROCESSING METHOD OF SCROLL INCLUDING A PROJECTION ON A TIP SEAL AND A HOLE IN A TIP SEAL GROOVE

(71) Applicant: MITSUBISHI HEAVY INDUSTRIES AUTOMOTIVE THERMAL SYSTEMS CO., LTD., Kiyosu-shi, Aichi (JP)

(72) Inventors: Hirofumi Hirata, Tokyo (JP); Takayuki Kuwahara, Tokyo (JP)

(73) Assignee: MITSUBISHI HEAVY INDUSTRIES AUTOMOTIVE THERMAL SYSTEMS, CO., LTD., Kiyosu-shi (JP)

( * ) Notice: Subject to any disclaimer, the term of this patent is extended or adjusted under 35 U.S.C. 154(b) by 197 days.

(21) Appl. No.: 13/846,190

(22) Filed: Mar. 18, 2013

(65) Prior Publication Data

US 2013/0251576 A1 Sep. 26, 2013

(30) Foreign Application Priority Data

Mar. 23, 2012 (JP) ..... 2012-067168

(51) Int. Cl.

| | |
|---|---|
| ***F04C 18/02*** | (2006.01) |
| ***F04C 18/00*** | (2006.01) |
| ***F04C 27/00*** | (2006.01) |

(52) U.S. Cl.

CPC ..... *F04C 18/00* (2013.01); *F04C 18/0215* (2013.01); *F04C 18/0276* (2013.01); *F04C 18/0284* (2013.01); *F04C 27/005* (2013.01); *Y10T 29/4924* (2015.01)

(58) Field of Classification Search

CPC ..... F04C 2/02; F04C 2/025; F04C 18/02–18/0292; F04C 27/005; F01C 1/02

USPC ..... 418/55.1–55.6, 57, 104, 140, 142; 417/310

See application file for complete search history.

(56) References Cited

U.S. PATENT DOCUMENTS

| | | | |
|---|---|---|---|
| 4,869,658 A | 9/1989 | Tsutsumi et al. | |
| 8,152,501 B2 * | 4/2012 | Fujita et al. | 418/55.4 |

(Continued)

FOREIGN PATENT DOCUMENTS

| | | |
|---|---|---|
| CN | 1177683 A | 4/1998 |
| CN | 1353247 A | 6/2002 |

(Continued)

OTHER PUBLICATIONS

German Office Action dated Nov. 24, 2014, issued in corresponding German Application No. 10-2013-004-492.8; w/English translation. (10 pages).

(Continued)

*Primary Examiner* — Jesse Bogue
*Assistant Examiner* — Laert Dounis
(74) *Attorney, Agent, or Firm* — Westerman, Hattori, Daniels & Adrian, LLP

(57) ABSTRACT

In a scroll compressor of the present invention, tip seals and are fitted in tip seal grooves provided in higher and lower tip surfaces of spiral wraps. One end of the tip seals then repeats contact and non-contact with a bottom land of the other scroll by a revolution in an orbiting manner of an orbiting scroll. In addition, a projection extending in a vertical direction from a back surface of the tip seals is provided at one end of the tip seals that become in a cantilever state. Furthermore, a hole in which the projection is fitted and engaged is formed in one end bottom surface of the tip seal grooves in which the tip seals are fitted.

18 Claims, 6 Drawing Sheets

(56) References Cited

U.S. PATENT DOCUMENTS

| | | | | |
|---|---|---|---|---|
| 2003/0194341 | A1* | 10/2003 | Takeuchi et al. | 418/55.2 |
| 2007/0048163 | A1* | 3/2007 | Midorikawa | F01C 19/08 418/55.4 |
| 2009/0060768 | A1 | 3/2009 | Takei | |
| 2010/0172780 | A1* | 7/2010 | Fujita et al. | 418/55.2 |

FOREIGN PATENT DOCUMENTS

| | | | |
|---|---|---|---|
| CN | 1366139 | A | 8/2002 |
| CN | 2553140 | Y | 5/2003 |
| CN | 101042135 | A | 9/2007 |
| JP | 59-190984 | U | 12/1984 |
| JP | 63-136283 | U | 9/1988 |
| JP | 3-8688 | U | 1/1991 |
| JP | 3-206385 | A | 9/1991 |
| JP | 6-42472 | A | 2/1994 |
| JP | 6-330872 | A | 11/1994 |
| JP | 8-28461 | A | 1/1996 |
| JP | 2001-517753 | A | 10/2001 |
| JP | 2005-351111 | A | 12/2005 |
| JP | 3881861 | B2 | 2/2007 |
| JP | 2009-74461 | A | 4/2009 |
| KR | 2011-0044320 | A | 4/2011 |
| WO | 99/15764 | A1 | 4/1999 |

OTHER PUBLICATIONS

Korean Notice of Allowance dated Oct. 27, 2014, issued in corresponding KR application No. 10-2013-29826 with English translation (4 pages).

Chinese Office Action dated Mar. 2, 2015, issued in corresponding CN Patent Application No. 201310088656.9 with English translation (23 pages).

Notification on the Grant of Patent Right for Invention dated Oct. 28, 2015, issued in counterpart Chinese Application No. 201310088656.9, with English translation (2 pages). Explanation of relevance—"The Notification on the Grant of Patent Right for Invention has been received."

Office Action dated Feb. 23, 2016, issued in counterpart Japanese Application No. 2012-067168, with English translation (11 pages).

* cited by examiner

SCROLL COMPRESSOR AND PROCESSING METHOD OF SCROLL INCLUDING A PROJECTION ON A TIP SEAL AND A HOLE IN A TIP SEAL GROOVE

CROSS REFERENCE TO RELATED APPLICATIONS

This application is based on Japanese Patent Application No. 2012-067168, with a filing date of Mar. 23, 2012, which is hereby incorporated by reference herein in its entirety.

TECHNICAL FIELD

The present invention relates to a scroll compressor in which a step is provided in an arbitrary position along a spiral direction of a fixed scroll and an orbiting scroll, and a processing method of the scroll.

BACKGROUND ART

In the technical field of scroll compressors, there has been a so-called stepped wrap scroll compressor in which a step is respectively provided at an arbitrary position along a spiral direction of both of a tip surface and a bottom land of a spiral wrap of each of a fixed scroll and an orbiting scroll, and in which a wrap height of an outer circumferential side of the spiral wrap relative to the step is made higher than a wrap height of an inner circumferential side thereof relative to the step. Since the scroll compressor can three-dimensionally compress a compressible fluid in both a circumferential direction and a height direction of the spiral wrap, it is possible to increase a planned volume ratio without increasing the winding number of the spiral wrap, and thus compactness in size and improvement in performance of the scroll compressor can be achieved.

In such stepped wrap scroll compressor, in order to reduce gas leak from a tip surface of the spiral wrap, a tip seal is respectively installed on a higher tip surface and a lower tip surface of the spiral wrap. However, with regard to the tip seal provided on the lower tip surface, its outer circumferential end repeats contact and non-contact with a bottom land due to a step provided on the bottom land of a spiral wrap of the corresponding scroll. At this time, there is a possibility that the tip seal becomes in a cantilever state to be bent, thereby becomes an extracted state from a seal groove to be caught by the step, and may become broken. Therefore, the outer circumferential end of the tip seal is usually installed away from the step.

In addition, also with regard to the tip seal installed on the lower tip surface of the spiral wrap of the orbiting scroll, at an inner circumferential end, the lower tip surface of the spiral wrap of the orbiting scroll crosses a discharge port provided in a center portion of the bottom land of the fixed scroll by revolution in an orbiting manner of the orbiting scroll, and repeats opening and closing the port. At this time, there is a possibility that the tip seal becomes in a cantilever state to be bent, thereby becomes an extracted state from the seal groove to be caught by the discharge port, and that a similar problem may occur. Therefore, the inner circumferential end of the tip seal is positioned at an outer circumferential position that is aside to the outer circumferential side from the inner circumferential end of the lower tip surface of the spiral wrap by a predetermined distance.

Similarly, also with regard to the tip seal provided in the higher tip surface of the spiral wrap of the fixed scroll and/or the orbiting scroll, there is a possibility that an outer circumferential end becomes in a cantilever state to be bent, thereby becomes an extracted state from the seal groove, and is caught between the spiral wrap and an end plate, in repeating separation and contact from/with the bottom land of the corresponding scroll. Therefore, the outer circumferential end is installed at an inner circumferential position that is aside to the inner circumferential side from the outer circumferential end of the higher tip surface of the spiral wrap by a predetermined distance.

Meanwhile, in The Publication of Japanese Patent No. 3881861 and Japanese Laid-open Patent Publication No. H8-28461, there are disclosed the following types of scroll compressors: a scroll compressor in which a tip seal is provided also at an uneven portion; a scroll compressor in which the tip seal is integrated with a tip seal of a higher and/or a lower tip surface; a scroll compressor in which separation of the tip seal is prevented by fitting a convex portion provided at one end of the tip seal provided at the uneven portion to a concave portion; a scroll compressor in which separation of the seal is prevented by fitting the tip seal provided at the uneven portion to a groove with a narrow opening and a wider inner side; a scroll compressor in which prevented are separation of the tip seal of the uneven portion and an extracted state of the tip seal that becomes in a cantilever state by pressing a tip of the other tip seal by means of an end surface of one tip seal, or by combining in a hook shape an end of one tip seal and an end of the other tip seal; etc.

In addition, in Japanese Laid-open Patent Publication No. H6-42472, there is disclosed a scroll compressor in which one or more projecting portions with a diameter equal to a width thereof are provided on a back surface of the tip seal, the projecting portions are fitted in a concave portion provided in a bottom surface of a seal groove, and in which gas leak through the seal groove is prevented. In Japanese Laid-open Patent Publication No. H6-330872, there is disclosed a scroll compressor in which a tip seal having a projection provided on a back surface thereof is elastically deformed to be fitted in a seal groove, the projection is made to contact with pressure with a concave portion provided in a bottom surface of the seal groove by means of a resilient force of the tip seal, and in which the tip seal can be held in the groove at the time of assembly. Furthermore, in Japanese Laid-open Patent Publication No. 2005-351111, there is disclosed a scroll compressor in which a tip seal is installed extending to an inner circumferential end of a spiral wrap by providing a convex portion and a concave portion that are fitted in each other at the inner circumferential ends of the tip seal and the seal groove, in which improvement of a compression efficiency is achieved, and in which damage due to an extracted state of the tip seal is prevented.

SUMMARY OF INVENTION

Technical Problem

In Japanese Patent No. 3881861 and Japanese Laid-open Patent Publication No. H8-28461, there is disclosed a scroll compressor in which a tip seal is respectively provided on a higher tip surface, a lower tip surface, and a step portion of a spiral wrap, with the step portion provided between the lower and higher tip surface of the spiral wrap, and thereby gas leak from a tip surface can be reduced near the step. However, it is difficult to prevent an extracted state of the tip seal only by integrating the tip seal of the higher and/or the lower tip surface with the tip seal of the step portion. In addition, there has been a problem that when the tip seal of the higher and/or the lower tip surface receives a force in a seal groove direction, there is a possibility of breakage in a tip seal of the step portion, etc.

In addition, there is disclosed a scroll compressor in which separation prevention is achieved by fitting a tip seal of an uneven portion in a groove with a narrow opening portion. However, such groove needs many processes, and thus it has been unsuitable for mass production. In addition, there is disclosed a scroll compressor in which in a case where a tip seal is provided only on a higher and a lower tip surfaces, in order to prevent an extracted state of an outer circumferential end of the tip seal provided on the lower tip surface, a concave portion formed by burrowing a seal groove to make a step, and one end of the tip seal is extended and inserted in the concave portion. However, in this case as well, processing of the concave portion needs many processes, and thus the scroll compressor has been unsuitable for mass production.

Furthermore, as a technology of preventing an extracted state of a tip seal that becomes in a cantilever state, in Japanese Laid-open Patent Publication No. 2005-351111, there is disclosed a scroll compressor in which an insertion hole toward a tip side and a side groove are provided in a tip seal groove, and in which a tongue-shaped portion and a flange portion provided on the tip seal are fitted in the insertion hole and the side groove. However, the technology has a problem that processing of the seal groove is complicated, etc. As described above, it is an actual situation that when a tip seal is installed to the edge portion of an inner circumferential end or an outer circumferential end of the tip surface of the wrap in order to reduce gas leak from a top surface, a technology that can reliably prevent an extracted state of the tip seal that becomes in a cantilever state, and that is suitable for mass production has not been established yet, and a current situation is also that early establishment of the technology is required.

Solution to Problem

The present invention has been made in view of such situation, and an object thereof is to provide a scroll compressor and a processing method of the scroll in which in a stepped wrap scroll compressor, gas leak from a tip surface of a spiral wrap can be reduced while breakage of a tip seal due to an extracted state thereof is prevented, efficiency can be improved, processing is easy to perform, and then mass production can be planned.

In order to solve the above-described problems, a scroll compressor and a processing method of the scroll of the present invention employ the following solutions.

Namely, a scroll compressor pertaining to a first aspect of the present invention is the scroll compressor comprising: a fixed scroll and an orbiting scroll each of which is provided with a step formed in each of a tip surface and a bottom land of a spiral wrap thereof, each of the steps being at a position along a spiral direction of the tip surface or the bottom land, and a wrap height of an outer circumferential side of the spiral relative to the step wrap being higher than a wrap height of an inner circumferential side thereof relative to the step; a tip seal groove provided in a higher tip surface and a lower tip surface of the spiral wrap of each of the fixed scroll and the orbiting scroll; and a tip seal fitted in each of the tip seal grooves of the fixed scroll and the orbiting scroll, wherein one end of the tip seal is provided with a projection extending in a vertical direction from a back surface of the tip seal, the one end of the tip seal is repeatedly situated in a contact state and a non-contact state with a bottom land of the corresponding scroll to be a cantilever state by a revolution in an orbiting manner of the orbiting scroll, and wherein the tip seal groove is provided with a hole in which the projection is fitted and engaged at one end bottom surface of the tip seal groove in which the tip seal is fitted.

According to this aspect, in the scroll compressor in which the step is respectively provided at the position along the spiral direction of the tip surface and the bottom land of the spiral wrap of the fixed scroll and the orbiting scroll, and in which the tip seal is provided on the higher and the lower tip surfaces of the spiral wrap, one end of the tip seal repeats contact and non-contact with the bottom land of the other scroll by a revolution in an orbiting manner of the orbiting scroll, the projection extending in the vertical direction from the back surface of the tip seal is provided at the one end of the tip seal that becomes in a cantilever state, the hole in which the projection is fitted and engaged is formed in the bottom surface of one end of the tip seal groove in which the tip seal is fitted, and thus even if one end of the tip seal provided on the tip surface of the spiral wrap is installed so as to extend to a position where it is in non-contact with the bottom land of the other scroll by a revolution in an orbiting manner of the orbiting scroll, and becomes in a cantilever state, an extracted state from the tip seal groove due to bend of one end of the tip seal that has become in a cantilever state can be prevented by means of fitting and engaging of the projection and the hole that are respectively provided on the one end of the tip seal and in the one end bottom surface of the tip seal groove. Accordingly, the tip seal is installed to the edge of the end side of the tip surface, and an installation area of the tip seal is enlarged, thereby gas leak from a tip surface is decreased, and further improvement in efficiency and in performance of a so-called stepped wrap scroll compressor can be achieved. Particularly, a performance improvement effect under a condition where a suction pressure is high at the time of low rotation is remarkable, and further compactness in size of the stepped wrap scroll compressor can be achieved. In addition, even if the tip seal is installed extending to the end as described above, a bite breakage accident etc. due to an extracted state of the end can be reliably prevented. Furthermore, an extracted state prevention means can be configured with the projection and the hole in the vertical direction that are respectively provided on the back surface of the tip seal and in the bottom surface of the tip seal groove, they can be simply processed, and thus mass production can be sufficiently secured.

Furthermore, a scroll compressor pertaining to a second aspect of the present invention is the scroll compressor comprising: a fixed scroll and an orbiting scroll each of which is provided with a step formed in each of a tip surface and a bottom land of a spiral wrap thereof, each of the steps being at a position along a spiral direction of the tip surface or the bottom land, and a wrap height of an outer circumferential side of the spiral relative to the step wrap being higher than a wrap height of an inner circumferential side thereof relative to the step; a tip seal groove provided in a higher tip surface and a lower tip surface of the spiral wrap of each of the fixed scroll and the orbiting scroll; and a tip seal fitted in each of the tip seal grooves of the fixed scroll and the orbiting scroll, wherein the tip seal groove provided in the higher and the lower tip surfaces of the spiral wrap is configured as a continuous tip seal groove over the step, and a crank-shaped integrated tip seal integrated through a connection portion over the step is fitted in the tip seal groove, and wherein a portion corresponding to the higher tip surface of the integrated tip seal is provided with a projection extending in a vertical direction from a back surface of the integrated tip seal, the projection is provided near the step, and the seal groove is provided with a hole in which the projection is fitted and engaged, the hole is provided at a bottom surface of a position near the step in the tip seal groove of the higher tip surface in which the integrated tip seal is fitted.

According to this aspect, in the scroll compressor in which the step is respectively provided at the position along the spiral direction of the tip surface and the bottom land of the spiral wrap of the fixed scroll and the orbiting scroll, and in which the tip seal is provided on the higher and the lower tip surfaces of the spiral wrap, the tip seal groove provided in the higher and the lower tip surfaces of the spiral wrap is made as the continuous tip seal groove over the step, the crank-shaped integrated tip seal integrated through the connection portion over the step is fitted and installed in the tip seal groove, and the projection extending in the vertical direction from the back surface of the tip seal is provided at the position near the step of the portion corresponding to the higher tip surface of the integrated tip seal, the hole in which the projection is fitted and engaged is formed in the bottom surface of the position near the step of the tip seal groove of the higher tip surface in which the integrated tip seal is fitted, and thus the integrated tip seal can be installed so as to cover a whole area of the inner circumferential side and the outer circumferential side that sandwich the step of the tip surface of the spiral wrap by fitting the crank-shaped integrated tip seal integrated through the connection portion over the step to the tip seal groove continuously provided in the higher and the lower tip surfaces over the step. In addition, an outer circumferential end portion that repeats contact and non-contact with the bottom land of the other scroll of the tip seal that is fitted in the tip seal groove of the lower tip surface is supported by the connection portion over the step, and thereby an extracted state due to bend of the end portion can be prevented. Furthermore, a force in a tip seal groove direction applied to the tip seal fitted in the tip seal groove of the higher tip surface can be received by means of fitting and engaging of the projection and the hole that are respectively provided at the position near the step and in the bottom surface of the position near the step of the tip seal groove. Accordingly, the tip seal is installed in the whole area of the inner circumferential side and the outer circumferential side that sandwich the step of the tip surface of the spiral wrap, and the installation area of the tip seal is enlarged, whereby gas leak from the tip surface is decreased, and further improvement in efficiency and in performance of the so-called stepped wrap scroll compressor can be achieved. Particularly, the aspect has an effect on performance improvement under the condition where the suction pressure is high at the time of low rotation, and further compactness in size of the stepped wrap scroll compressor can be achieved. In addition, by installing the integrated tip seal as described above, can be prevented the bite breakage accident etc. due to an extracted state of the outer circumferential end portion of the integrated tip seal installed in the tip seal groove of the lower tip surface, and can be prevented a breakage accident etc. of the connection portion of the integrated tip seal due to a force in a direction along the groove that is applied to the tip seal fitted in the tip seal groove of the higher tip surface. In addition, in this case, an extracted state of a tip seal portion of the lower tip surface side can be supported by the connection portion of the integrated tip seal, a fitting portion is not needed other than the projection and the hole in the vertical direction that are respectively provided on the tip seal and in the tip seal groove that are provided on the higher tip surface side, they can be easily processed, and thus mass production can be sufficiently secured.

Furthermore, a scroll compressor pertaining to a third aspect of the present invention is the above-described scroll compressor, wherein the tip seal groove over the step is made as a step portion tip seal groove having a semi-circular cross section with a diameter equal to a groove width of the tip seal groove provided on the tip surface.

According to this aspect, since the tip seal groove over the step is made as the step portion tip seal groove having the semi-circular cross section with the diameter equal to the groove width dimension of the tip seal groove provided on the tip surface side, the step portion tip seal groove can be cut using an end mill with which the tip seal groove of the tip surface side is cut at the same time of processing of the tip seal groove of the tip surface side. Accordingly, even if the continuous tip seal groove over the step is provided, processing of the fixed scroll and the orbiting scroll is not particularly complicated, and processing of both scrolls can be simplified.

Furthermore, a scroll compressor pertaining to a fourth aspect of the present invention is the above-described scroll compressor, wherein a fitting portion having a semi-circular cross section with a diameter equal to a width of the integrated tip seal fitted in the step portion tip seal groove is provided at the connection portion of the integrated tip seal.

According to this aspect, since the fitting portion having the semi-circular cross section with the diameter equal to the width dimension of the integrated tip seal fitted in the step portion tip seal groove is provided at the connection portion of the integrated tip seal, by fitting the fitting portion in the step portion tip seal groove having the semi-circular cross section, the integrated tip seal can be stably fitted and installed in the continuous tip seal groove provided in the higher and the lower tip surfaces with good settlement, and the tip seal fitted in the lower tip surface can be prevented from being loose by using the connection portion as a support. Accordingly, by means of the integrated tip seal that is stably fitted and installed with good settlement, gas leak near the step is sufficiently reduced, and performance of the so-called stepped wrap scroll compressor can be much more improved.

Furthermore, a scroll compressor pertaining to a fifth aspect of the present invention is any of the above-mentioned scroll compressors, wherein a step tip surface having a semi-circular cross section with a diameter equal to a thickness of the spiral wrap is integrally molded at the connection portion of the integrated tip seal.

According to this aspect, since the step tip surface having the semi-circular cross section with the diameter equal to the tooth thickness dimension of the spiral wrap is integrally molded at the connection portion of the integrated tip seal, a mesh surface between the steps that is provided on the bottom land of the spiral wrap of the other scroll can be sealed by means of the step tip surface having the semi-circular cross section integrally molded at the tip seal. Accordingly, in the so-called stepped wrap scroll compressor, gas leak from a step mesh surface regarded as gas leak being most likely to occur is reduced, and performance of the stepped wrap scroll compressor can be much more improved.

Furthermore, a scroll compressor pertaining to a sixth aspect of the present invention is any of the above-mentioned scroll compressors, wherein the projection of the tip seal is formed as a cylindrical projection, and the hole of the tip seal groove in which the projection is fitted and engaged is formed as a cylindrical hole.

According to this aspect, since the projection of the tip seal side is made as the cylindrical projection, and the hole of the tip seal groove side in which the projection is fitted and engaged is made as the cylindrical hole, an extracted state of the tip seal due to bend of the end thereof can be prevented by means of catch of the cylindrical projection in the cylindrical hole that are fitted in each other, and installation and processing of the projection and the hole that are respectively provided on the tip seal and in the tip seal groove can be made easy to perform. That is, although there is no particular problem in molding the projection on the tip seal generally made of resin, the hole provided in the tip seal groove of a metal scroll needs to be machined (cut), and it is effective in making processing easier that the hole is made as the cylindrical one. Accordingly, even if the hole is provided in the tip seal groove, processing is not particularly complicated, and the hole can be simply processed as an extension of machining of the tip seal groove.

Furthermore, a scroll compressor pertaining to a seventh aspect of the present invention is any of the above-mentioned scroll compressors, wherein the cylindrical projection and the cylindrical hole are formed as a projection with the diameter as the width of the tip seal, and a hole with the same diameter as the groove width of the tip seal groove, respectively.

According to this aspect, since the cylindrical projection and the cylindrical hole are made as the projection with the diameter which is the same as the width of the tip seal and the hole with the diameter which is the same as the groove width of the tip seal groove, respectively, fitting of the tip seal in the tip seal groove can be performed substantially similarly to fitting of a tip seal without a projection and a tip seal groove without a hole, and the hole provided in the tip seal groove can be processed by the end mill with which the tip seal groove is cut at the same time of groove processing. Accordingly, even if the projection and the hole are respectively provided on the tip seal and in the tip seal groove, attachment of the tip seal, and processing of the fixed scroll and the orbiting scroll are not particularly complicated, and processing of both scrolls can be simplified.

Furthermore, a scroll compressor pertaining to an eighth aspect of the present invention is any of the above-mentioned scroll compressors, wherein the projection is provided on the outer circumferential end of the tip seal fitted on the lower tip surface of the spiral wrap, and the hole is provided in a bottom surface of the outer circumferential end of the corresponding tip seal groove.

According to this aspect, since the projection is provided on the outer circumferential end of the tip seal provided on the lower tip surface of the spiral wrap among the tip seals, and the hole is provided in the bottom surface of the outer circumferential end of the corresponding tip seal groove, by means of fitting and engaging of the projection and the hole, it can be prevented that an extracted state of the tip seal from the tip seal groove due to bend of the outer circumferential end of the tip seal that repeats contact and non-contact with the bottom land by moving on the step of the bottom land side of the other scroll by a revolution in an orbiting manner of the orbiting scroll, becomes in a cantilever state, and is provided on the lower tip surface of the spiral wrap. Accordingly, the tip seal is installed to the edge of the outer circumferential end of the lower tip surface of the spiral wrap, the installation area of the tip seal is enlarged, thereby gas leak from the end tip surface is decreased, improvement in efficiency and in performance of the so-called stepped wrap scroll compressor can be achieved, and even if the tip seal provided on the lower tip surface of the spiral wrap is installed extending as described above, the bite breakage accident etc. due to an extracted state of the end can be reliably prevented.

Furthermore, a scroll compressor pertaining to a ninth aspect of the present invention is any of the above-mentioned scroll compressors, wherein the projection is provided near the outer circumferential end of the tip seal fitted on the higher tip surface of the spiral wrap of the fixed scroll and/or the orbiting scroll, and the hole is provided in the bottom surface near the outer circumferential end of the corresponding tip seal groove.

According to this aspect, since the projection is provided near the outer circumferential end of the tip seal provided on the higher tip surface of the spiral wrap of the fixed scroll and/or the orbiting scroll among the tip seals, and the hole is provided in the bottom surface near the outer circumferential end of the corresponding tip seal groove, by means of mutual fitting and engaging of the projection and the hole, it can be prevented that an extracted state of the tip seal from the tip seal groove due to bend of the outer circumferential end of the tip seal that repeats separation and contact from/with the bottom land of the other scroll whose end plate outer diameter is made small by a revolution in an orbiting manner of the orbiting scroll, becomes in a cantilever state, and is provided on the higher tip surface of the spiral wrap. Accordingly, the tip seal is installed close to the outer circumferential end of the higher tip surface of the spiral wrap of the fixed scroll and/or the orbiting scroll, the installation area of the tip seal is enlarged, thereby gas leak from the end tip surface is decreased, and improvement in efficiency and in performance of the stepped wrap scroll compressor can be achieved. In addition, even if the tip seal provided on the higher tip surface of the spiral wrap is installed extending as described above, the bite breakage accident etc. due to an extracted state of the end can be reliably prevented.

Furthermore, a scroll compressor pertaining to a tenth aspect of the present invention is any of the above-mentioned scroll compressors, wherein the projection is provided on the inner circumferential end of the tip seal fitted on the lower tip surface of the spiral wrap of the orbiting scroll, and the hole is provided in a bottom surface of the inner circumferential end of the corresponding tip seal groove.

According to this aspect, since the projection is provided on the inner circumferential end of the tip seal provided on the lower tip surface of the spiral wrap of the orbiting scroll among the tip seals, and the hole is provided in the bottom surface of the inner circumferential end of the corresponding tip seal groove, by means of mutual fitting and engaging of the projection and the hole, it can be prevented that the inner circumferential end of the tip seal, which is provided on the lower tip surface of the spiral wrap of the orbiting scroll that repeats opening and closing, crossing the discharge port provided in the center portion of the bottom land of the fixed scroll, becomes in a cantilever state by a revolution in an orbiting manner of the orbiting scroll, is bent, and that thereby the tip seal becomes loose from the tip seal groove. Accordingly, the tip seal is installed to the edge of the inner circumferential end of the lower tip surface of the spiral wrap of the orbiting scroll, the installation area of the tip seal is enlarged, thereby gas leak from the end tip surface is decreased, and improvement in efficiency and in performance of the stepped wrap scroll compressor can be achieved. In addition, even if the tip seal provided on the lower tip surface of the spiral wrap of the orbiting scroll is installed extending as described above, the bite breakage accident etc. due to an extracted state of the end can be reliably prevented.

Furthermore, a processing method of a scroll pertaining to an eleventh aspect of the present invention is the processing method comprising Processing the tip seal groove and the hole by an end mill by moving the end mill in a depth direction of the hole at a position in the tip seal groove in which the hole is to be formed when the tip seal groove being cut by the same end mill.

According to this aspect, in the processing method of the scroll that processes the tip seal grooves of the spiral wraps in the fixed and the orbiting scrolls of any of the above-mentioned scroll compressors, in the tip seal groove being cut by the end mill, the end mill is moved in the depth direction of the hole at the position of the hole formed in the groove bottom surface, thereby the tip seal groove and the hole are simultaneously processed by the same end mill, and thus when the end of the tip seal becomes in a cantilever state by a revolution in an orbiting manner of the orbiting scroll, processing of the tip seal groove including the hole that prevents an extracted state due to bend of the end can be simultaneously performed only by using the same end mill, and moving the end mill in the depth direction of the hole at a hole position. Accordingly, the tip seal groove of the fixed and the orbiting scrolls that includes the hole can be efficiently processed, and reduction in productivity due to perforating the hole can be suppressed to the minimum.

Furthermore, a processing method of a scroll pertaining to a twelfth aspect of the present invention is the above-described processing method of the scroll, wherein subsequent to the cutting of the tip seal groove of the tip surface, the step portion tip seal groove having a semi-circular cross section that is provided in the step is simultaneously cut using the same end mill.

According to this aspect, subsequent to the cutting of the tip seal groove of the tip surface, the step portion tip seal groove having the semi-circular cross section that is provided in the step can be simultaneously cut using the end mill, and thus even if the step portion tip seal groove having the semi-circular cross section is provided in the steps of the fixed and the orbiting scrolls, the step portion tip seal groove can be simultaneously cut using the same end mill as an extension of cutting of the tip seal groove provided in the higher and the lower tip surfaces of the spiral wrap. Accordingly, even when an integrated tip seal is installed, the step portion tip seal groove having the semi-circular cross section can be efficiently processed in the steps of the fixed and the orbiting scrolls, and reduction in productivity due to providing the tip seal groove in the step can be suppressed to the minimum.

Advantageous Effects of Invention

According to the scroll compressors pertaining to the above-described aspects of the present invention, even if one end of the tip seal provided on the tip surface of the spiral wrap is installed so as to extend to the position where it becomes in non-contact with the bottom land of the corresponding scroll by a revolution in an orbiting manner of the orbiting scroll, and becomes in a cantilever state, an extracted state from the tip seal groove due to bend of one end of the tip seal that has become in a cantilever state can be prevented by means of fitting and engaging of the projection and the hole that are respectively provided at the one end of the tip seal and in one end bottom surface of the tip seal groove, and thus the tip seal can be installed to the edge of the end side of the tip surface, the installation area of the tip seal is enlarged, thereby gas leak from the tip surface is decreased, and further improvement in efficiency and in performance of the stepped wrap scroll compressor can be achieved. Particularly, the performance improvement effect under the condition where the suction pressure is high at the time of low rotation is remarkable, and further compactness in size of the stepped wrap scroll compressor can be achieved. In addition, even if the tip seal is installed extending to the end as described above, the bite breakage accident etc. due to an extracted state of the end can be reliably prevented. Furthermore, an extracted state prevention means can be configured with the projection and the hole in the vertical direction that are respectively provided on the back surface of the tip seal and in the bottom surface of the tip seal groove, they can be simply processed, and thus mass production can be sufficiently secured.

In addition, according to the scroll compressors pertaining to the above-described aspects of the present invention, the integrated tip seal can be installed so as to cover the whole area of the inner circumferential side and the outer circumferential side that sandwich the step of the tip surface of the spiral wrap by fitting the crank-shaped integrated tip seal integrated through the connection portion over the step to the tip seal groove continuously provided in the higher and the lower tip surfaces over the step. In addition, the outer circumferential end portion that repeats contact and non-contact with the bottom land of the other scroll of the tip seal portion that is fitted in the tip seal groove of the lower tip surface is supported by the connection portion over the step, and thereby an extracted state due to bend of the end portion can be prevented. Furthermore, since the force in the tip seal groove direction applied to the tip seal portion fitted in the tip seal groove of the higher tip surface can be received by means of fitting and engaging of the projection and the hole that are respectively provided at the position near the step and in the bottom surface of the position near the step of the tip seal groove, the tip seal is installed in the whole area of the inner circumferential side and the outer circumferential side that sandwich the step of the tip surface of the spiral wrap, and the installation area of the tip seal is enlarged, whereby gas leak from the tip surface is decreased, and further improvement in efficiency and in performance of the stepped wrap scroll compressor can be achieved. Particularly, the above-described aspects have an effect in performance improvement under the condition where the suction pressure is high at the time of low rotation, and further compactness in size of the stepped wrap scroll compressor can be achieved. In addition, by installing the integrated tip seal as described above, can be prevented the bite breakage accident etc. due to an extracted state of the outer circumferential end portion of the integrated tip seal installed in the tip seal groove of the lower tip surface, and can be prevented the breakage accident etc. of the connection portion of the integrated tip seal due to the force in the groove direction that is applied to the tip seal portion fitted in the tip seal groove of the higher top land. Furthermore, in this case, an extracted state of the tip seal portion of the lower top land side can be supported by the connection portion of the integrated tip seal, a fitting portion is not needed other than the projection and the hole in the vertical direction that are respectively provided on the tip seal and in the tip seal groove that are provided on the higher tip surface side, they can be easily processed, and thus mass production can be sufficiently secured.

In addition, according to the processing methods of the scroll pertaining to the above-described aspects of the present invention, when the end of the tip seal becomes in a cantilever state by a revolution in an orbiting manner of the orbiting scroll, processing of the tip seal groove including the hole that prevents an extracted state due to bend of the end can be simultaneously performed only by using the same end mill, and moving the end mill in the depth direction of the hole at the hole position, and thus the tip seal groove of the fixed and the orbiting scrolls that include the hole can be efficiently processed, and reduction in productivity due to perforating the hole can be suppressed to the minimum.

DESCRIPTION OF EMBODIMENTS

Hereinafter, embodiments pertaining to the present invention will be described with reference to drawings.

First Embodiment

Hereinafter, a first embodiment of the present invention will be described using FIGS. 1 to 3.

Figure 1:
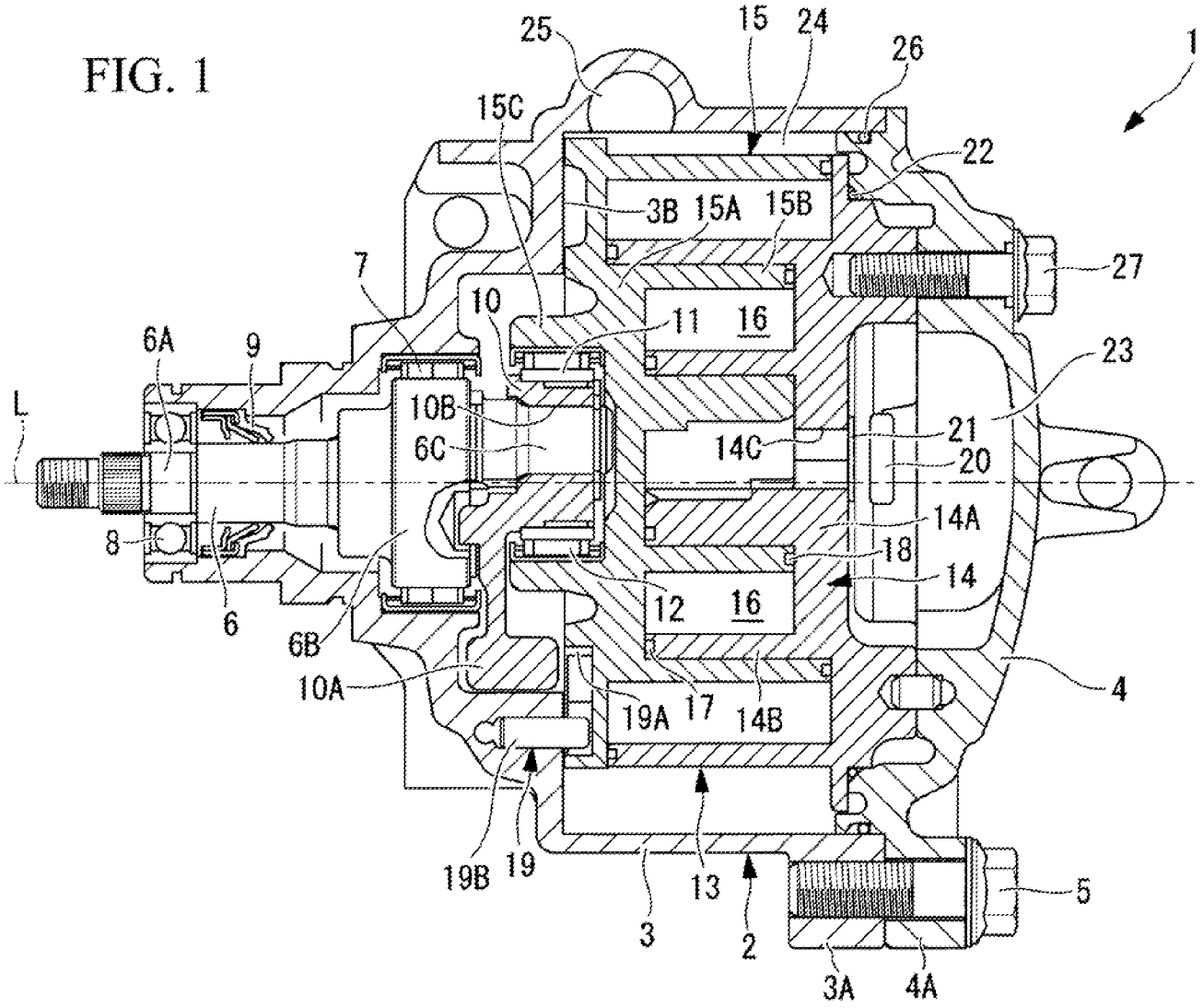
FIG. 1 is a longitudinal sectional view of a scroll compressor pertaining to a first embodiment of the present invention.

FIG. 1 shows a longitudinal sectional view of a scroll compressor pertaining to the first embodiment of the present invention, FIG. 2A a perspective view of a fixed scroll of the scroll compressor, and FIG. 2B a perspective view of an orbiting scroll thereof.

A scroll compressor 1 has a housing 2 constituting a shell, and the housing 2 is configured by integrally tightening and fixing a front housing 3 and a rear housing 4 by means of a bolt 5.

In the front housing 3 and the rear housing 4, flanges 3A and 4A for tightening are integrally formed at a plurality of points (for example, four points) on circumferences thereof at regular intervals, and the front housing 3 and the rear housing 4 are integrally combined with each other by tightening the flanges 3A and 4A by means of the bolt 5. Inside the front housing 3, a crankshaft (drive shaft) 6 is rotatably supported around an axis line L through a main bearing 7 and a sub-bearing 8.

One end side (left side in FIG. 1) of the crankshaft 6 is made as a small-diameter shaft portion 6A, and the small-diameter shaft portion 6A penetrates the front housing 3 to be projected to the left side of FIG. 1. An electromagnetic clutch that receives power as is well-known, which is not shown, a pulley, etc. are provided at a projecting portion of the small-diameter shaft portion 6A, and power is transmitted through a V-belt etc. from drive sources, such as an engine. A mechanical seal (lip seal) 9 is installed between the main bearing 7 and the sub-bearing 8, and airtightly seals between inside of the housing 2 and the atmosphere.

A large-diameter shaft portion 6B is provided on the other end side (right side in FIG. 1) of the crankshaft 6, and a crankpin 6C is integrally provided at the large-diameter shaft portion 6B eccentrically from the axis line L of the crankshaft 6 by a predetermined dimension. The large-diameter shaft portion 6B and the small-diameter shaft portion 6A are supported by the front housing 3 through the main bearing 7 and the sub-bearing 8, and thereby the crankshaft 6 is rotatably supported. An orbiting scroll 15, which will be described hereinafter, is coupled to the crankpin 6C through a drive bush 10, a cylindrical ring (floating bush) 11, and a drive bearing 12, and the orbiting scroll 15 is orbitingly driven by the crankshaft 6 being rotated.

A balance weight 10A for removing an imbalanced load generated by the orbiting scroll 15 is orbitingly driven is integrally provided at the drive bush 10, and is orbited together with orbiting drive of the orbiting scroll 15. In addition, at the drive bush 10, a crankpin hole 10B in which the crankpin 6C is fitted is provided at an eccentric position with respect to the center of the drive bush 10. As a result, configured is a well-known driven crank mechanism in which the drive bush 10 and the orbiting scroll 15 that have been fitted in the crankpin 6C are turned around the crankpin 6C in response to a compression reaction force of gas, and make an orbiting radius of the orbiting scroll 15 variable.

In addition, in the housing 2, a scroll compression mechanism 13 configured by a pair of a fixed scroll 14 and the orbiting scroll 15 is incorporated. The fixed scroll 14 is configured with a fixed end plate 14A and a fixed spiral wrap 14B vertically arranged on the fixed end plate 14A, and the orbiting scroll 15 is configured with an orbiting end plate 15A and an orbiting spiral wrap 15B vertically arranged on the orbiting end plate 15A.

Figure 2:
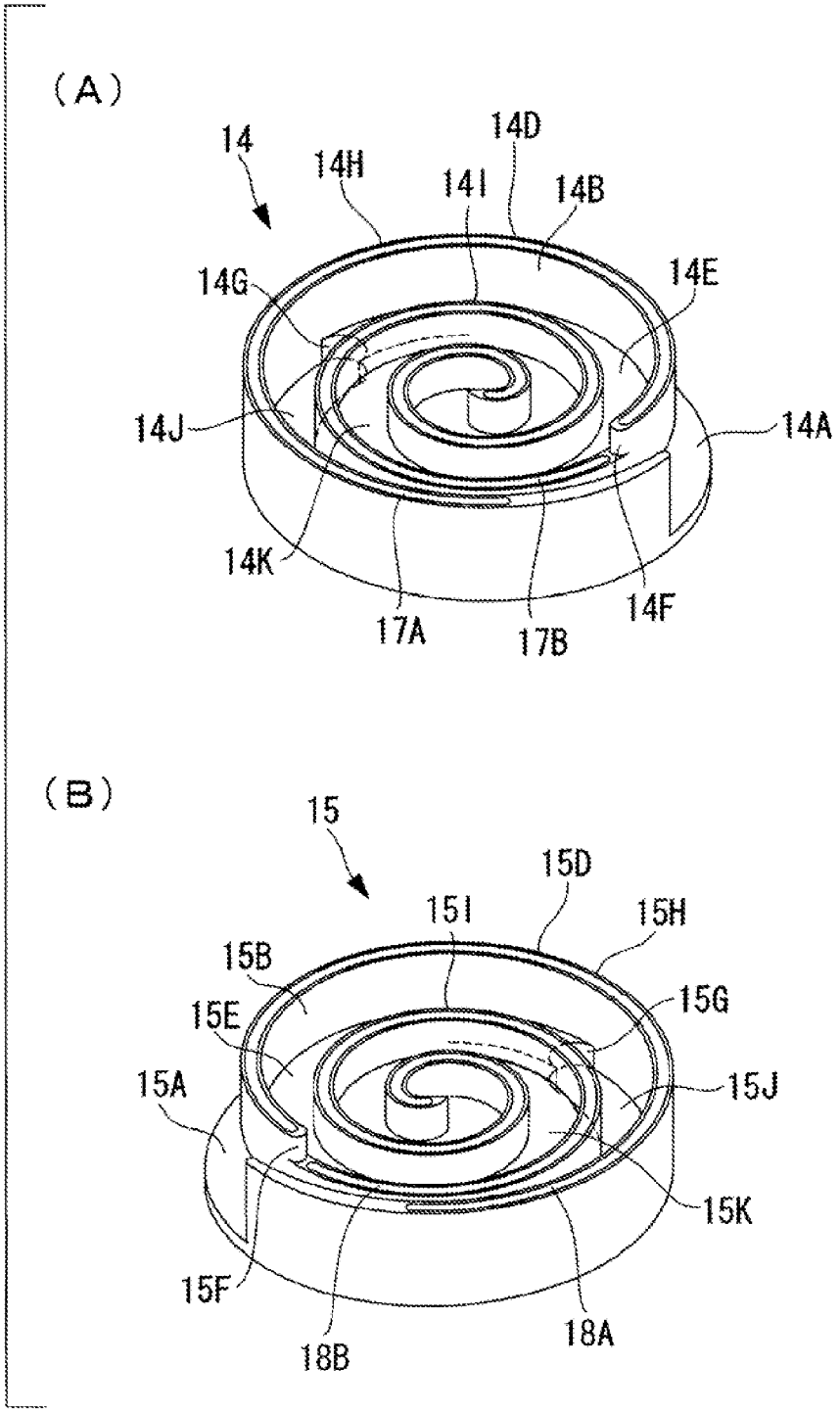
FIGS. 2A and 2B are perspective views of a fixed scroll and an orbiting scroll of the scroll compressor shown in FIG. 1.
Figure 3:
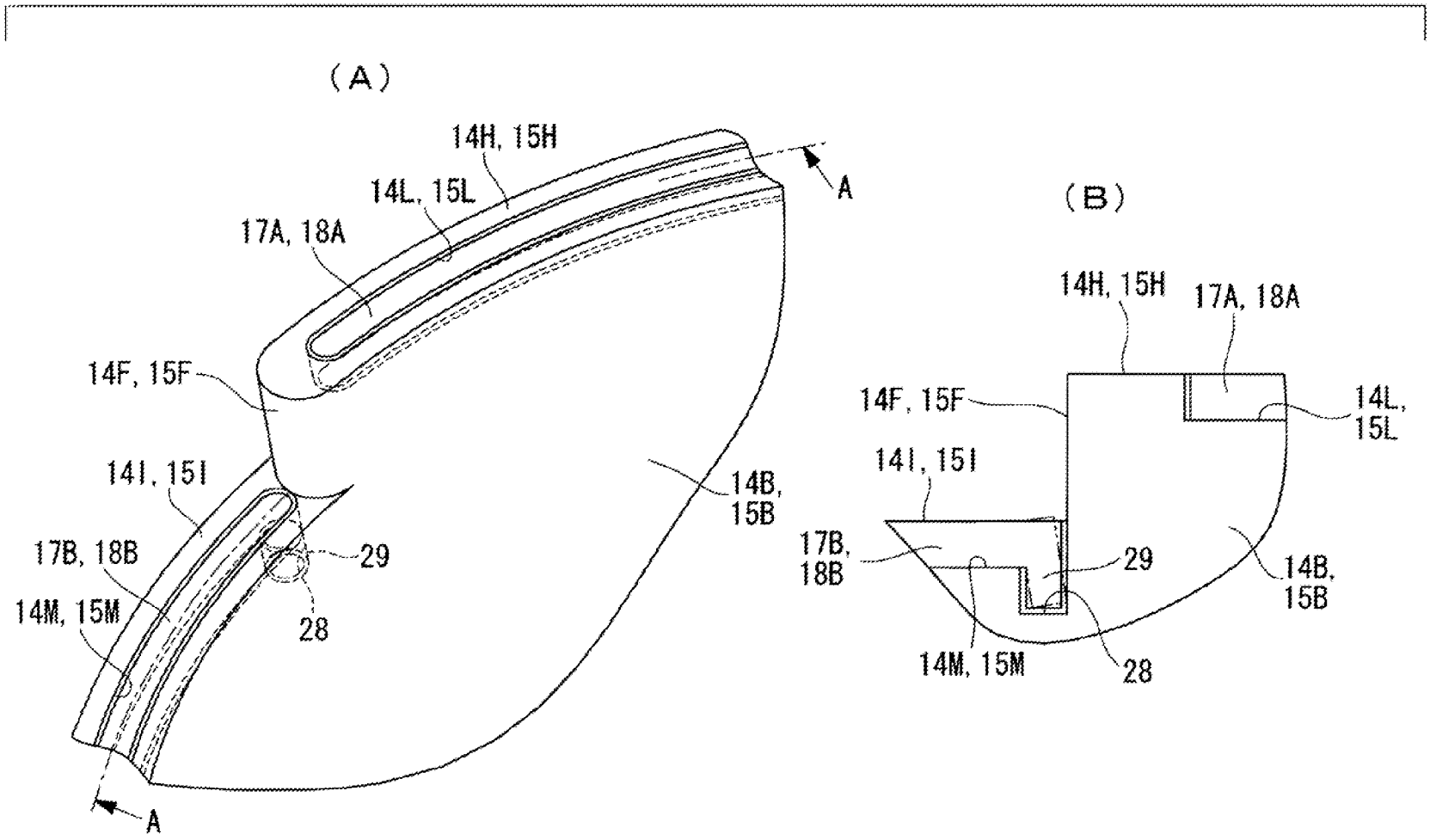
FIG. 3A is an enlarged perspective view of the vicinity of a step of a tip surface of a spiral wrap of the fixed and the orbiting scrolls shown in FIG. 2.
FIG. 3B is a cross-sectional view taken along a line A-A of FIG. 3A.

At the fixed scroll 14 and the orbiting scroll 15, as shown in FIG. 2, steps 14F and 15F, and 14G and 15G are respectively provided at predetermined positions along a spiral direction of tip surfaces 14D and 15D, and bottom lands 14E and 15E of the respective spiral wraps 14B and 15B. With these steps 14F and 15F, and 14G and 15G as boundaries, on the tip surface 14D and 15D sides, tip surfaces 14H and 15H of the outer circumferential side are made higher than the axis line L (referred to as higher tip surfaces 14H and 15H), and tip surfaces 14I and 15I of the inner circumferential side are made lower (referred to as lower tip surfaces 14I and 15I). In addition, the respective tip surfaces are made as flat surfaces having the same height.

Meanwhile, on the bottom land 14E and 15E sides, bottom lands 14J and 15J of the outer circumferential side are made lower than the axis line L (referred to as lower bottom lands 14J and 15J), and bottom lands 14K and 15K of the inner circumferential side are made higher (referred to as higher bottom lands 14K and 15K). In addition, the respective bottom lands are made as flat surfaces having the same height. As a result, a wrap height in the outer circumferential side of the respective spiral wraps 14B and 15B is made higher than a wrap height of the inner circumferential side thereof.

The fixed scroll 14 and the orbiting scroll 15 are meshed with each other, with the centers thereof being separated from each other by an orbiting radius p, and phases of the respective spiral wraps 14B and 15B being displaced by 180 degrees. In addition, the fixed scroll 14 and the orbiting scroll 15 are attached to each other so that a slight clearance of a wrap height direction at a room temperature is formed between the tip surfaces 14D and 15D and the bottom lands 14E and 15E of the other scroll. As a result, as shown in FIG. 1, plural pairs of compression chambers 16 whose boundaries are limited by the respective end plates 14A and 15A and the respective spiral wraps 14B and 15B are formed point-symmetrically with respect to scroll centers between both the scrolls 14 and 15, and the orbiting scroll 15 can smoothly orbit around the fixed scroll 14.

A height of the compression chamber 16 in the axis line L is made higher in the outer circumferential side of the respective spiral wraps 14B and 15B than in the inner circumferential side thereof. As a result, the scroll compression mechanism 13 is configured that can perform three-dimensional compression in which gas can be compressed in both a circumferential direction and a height direction of the respective spiral wraps 14B and 15B. On the tip surfaces 14D and 15D of the respective spiral wraps 14B and 15B of the fixed scroll 14 and the orbiting scroll 15, installed are tip seals 17 and 18 for sealing a tip seal surface formed between the bottom lands 14E and 15E of the other scroll. Specifically, the tip seals 17 and 18 are installed by being fitted in grooves provided in the tip surfaces 14D and 15D, respectively.

The fixed scroll 14 is fixedly installed on an inner surface of the rear housing 4 through a bolt 27. In addition, the orbiting scroll 15 is, as mentioned above, installed so that the crankpin 6C provided at one end side of the crankshaft 6 is coupled to a boss portion 15C provided on a back surface of the orbiting end plate 15A through the drive bush 10, the cylindrical ring (floating bush) 11, and the drive bearing 12, and that thereby the orbiting scroll 15 is orbitingly driven.

Furthermore, in the orbiting scroll 15, the back surface of the orbiting end plate 15A is supported by a thrust receiving surface 3B of the front housing 3. In addition, the orbiting scroll 15 is configured such that a revolution in an orbiting manner is performed around the fixed scroll 14 while rotation is prevented through a rotation blocking mechanism 19 provided between the thrust receiving surface 3B and the back surface of the orbiting end plate 15A. The rotation blocking mechanism 19 of the present embodiment is made as a pin-ring type rotation blocking mechanism 19 in which a rotation blocking pin 19B incorporated in a pin hole of a front housing 3 side is slidably fitted in an inner peripheral surface of a rotation blocking ring 19A incorporated in a ring hole provided in the orbiting end plate 15A of the orbiting scroll 15.

A discharge port 14C from which refrigerant gas compressed by a central portion of the fixed end plate 14A is discharged is opened in the fixed scroll 14, and a discharge valve 21 attached to the fixed end plate 14A through a retainer 20 is installed in the discharge port 14C. In addition, on a back surface side of the fixed end plate 14A, a sealing material 22, such as an O-ring, is interposed so as to be closely in contact with an inner surface of the rear housing 4, and a discharge chamber 23 partitioned from an internal space of the housing 2 is formed between the inner surface of the rear housing 4 and the back surface side of the fixed end plate 14A. As a result, the scroll compressor of the embodiment is configured such that the internal space of the housing 2 excluding the discharge chamber 23 functions as a suction chamber 24.

Refrigerant gas that returns from a refrigerating cycle is suctioned in the suction chamber 24 through a suction port 25 provided in the front housing 3, and the refrigerant gas is sucked in the compression chamber 16 through the suction chamber 24. A sealing material 26, such as the O-ring, is interposed on a joint surface between the front housing 3 and the rear housing 4, and airtightly seals the suction chamber 24 formed in the housing 2 from the atmosphere.

FIG. 3A shows an enlarged perspective view of the vicinity of steps 14F and 15F provided on the tip surface 14D and 15D sides of the spiral wraps 14B and 15B of the fixed scroll 14 and the orbiting scroll 15 in the above-described scroll compressor 1, and FIG. 3B shows a cross-sectional view taken along a line A-A of FIG. 3A. It is to be noted that although the step 14F of the fixed scroll 14 side and the step 15F of the orbiting scroll 15 side are normally represented reversely, the embodiment will be described using one step for convenience herein.

Tip seal grooves 14L and 15L, and 14M and 15M are respectively provided in the higher tip surfaces 14H and 15H and the lower tip surfaces 14I and 15I, with the steps 14F and 15F provided on the tip surface 14D and 15D sides of the spiral wraps 14B and 15B of the fixed scroll 14 and the orbiting scroll 15 as boundaries, and tip seals 17 and 18 are respectively fitted and installed in the respective tip seal grooves 14L and 15L, and 14M and 15M. Herein, tip seals provided on the higher tip surface 14H and 15H sides are made as tip seals 17A and 18A, and tip seals provided on the lower bottom land 14J and 15J sides are made as tip seals 17B and 18B.

Among the above-described tip seal grooves 14L and 15L, and 14M and 15M, the tip seal grooves 14M and 15M on the lower bottom land 14I and 15I sides are, as shown in FIGS. 3A and 3B, provided extending to the edge of roots of the steps 14F and 15F, the tip seals 17B and 18B with which the higher bottom lands 14K and 15K of the other scrolls 14 and 15 will get contact being fitted and installed in the tip seal grooves 14M and 15M. In addition, on a bottom surface of the outer circumferential end of the tip seal grooves 14M and 15M, a cylindrical hole 28 with a diameter the same as a groove width dimension of the tip seal grooves 14M and 15M is formed in a vertical direction.

The cylindrical hole 28 formed in the bottom surface of the tip seal grooves 14M and 15M can be formed by moving the end mill in the vertical direction by a depth of the hole 28 at an outer circumferential end position of the tip seal grooves 14M and 15M, in the tip seal grooves 14M and 15M being cut by the end mill.

Meanwhile, the tip seals 17B and 18B that are fitted and installed in the above-described tip seal grooves 14M and 15M, the tip seals 17B and 18B being provided on the lower bottom land 14I and 15I sides, are made as the tip seals with a length extending to the edge of the outer circumferential end of the lower bottom lands 14I and 15I, and a cylindrical projection 29 with a diameter the same as a width dimension of the tip seals 17B and 18B is provided projecting in the vertical direction on a back surface of an outer circumferential end of the tip seals 17B and 18B. The projection 29 is fitted and engaged in the cylindrical hole 28 formed in the bottom surface of the tip seal grooves 14M and 15M. It is to be noted that the tip seals 17 and 18 including the tip seals 17B and 18B are products made of a resin material, such as PPS, and can be integrally molded together with the projection 29 by means of injection molding.

With a configuration described above, according to the embodiment, the following operational effects are exerted.

When power is transmitted to the crankshaft 6 through the pulley, the electromagnetic clutch, etc. from an external drive source, and the crankshaft 6 is rotated, a revolution in an orbiting manner of the orbiting scroll 15 whose orbiting radius is variably coupled to the crankpin 6C through the drive bush 10, the cylindrical ring (floating bush) 11, and the drive bearing 12 is performed to around the fixed scroll 14 with a predetermined orbiting radius, while rotation being blocked by the pin-ring type rotation blocking mechanism 19.

Refrigerant gas in the suction chamber 24 is taken in the pair of compression chambers 16 formed on a radial outermost circumference by a revolution in an orbiting manner of the orbiting scroll 15. Suction is closed at a predetermined orbiting angle position in the compression chamber 16, and subsequently, the compression chamber 16 is moved to a center side, while a volume thereof being decreased in the circumferential direction and the wrap height direction. The refrigerant gas is compressed in the meantime, and when the compression chamber 16 reaches a position of communicating with the discharge port 14C, a discharge reed valve 21 is pushed open. As a result of it, the compressed gas with a high temperature and a high pressure is discharged in the discharge chamber 23, and is sent outside the scroll compressor 1 through the discharge chamber 23.

In the meantime, the compression chamber 16 is sealed with: a side seal performed by side surfaces of the spiral wraps 14B and 15B of the fixed scroll 14 and the orbiting scroll 15 getting contact with each other; and a tip surface seal performed by the tip seals 17A and 18A, and 17B and 18B that are provided on the tip surfaces 14H and 15H, and 14I and 15I of the other scrolls 14 and 15 getting contact with the bottom lands 14J and 15J, and 14K and 15K of the respective scroll spiral wraps 14B and 15B. Reducing seal leak during this compression stroke as much as possible then leads to highly efficient compression.

In the embodiment, in the outer circumferential end of the lower tip surfaces 14I and 15I of the spiral wraps 14B and 15B of the fixed scroll 14 and the orbiting scroll 15, the outer circumferential end repeating contact and non-contact with the higher bottom lands 14K and 15K of the other scrolls 14 and 15, with the steps 14G and 15G provided at the bottom lands 14E and 15E of the other scrolls 14 and 15 as boundaries, the tip seal grooves 14M and 15M are provided extending to the edge of the roots of the steps 14F and 15F. In addition, the tip seals 17B and 18B extending to the edge of the outer circumferential end of the lower bottom lands 14I and 15I are fitted and installed in the tip seal grooves 14M and 15M. Therefore, gas leak from the tip surface near the outer circumferential end of the lower bottom lands 14I and 15I can be reliably reduced.

In addition, when the tip seals 17B and 18B are installed extending to the edge of the outer circumferential end of the lower bottom lands 14I and 15I, a case occurs where one end of the tip seals 17B and 18B becomes in a cantilever state by repeating contact and non-contact with the higher bottom lands 14K and 15K. However, even though by the above-described movement, the one end of the tip seals 17B and 18B bends and tends to be loose from the tip seal grooves 14M and 15M, as shown with a dashed line in FIG. 3B, an extracted state of the tip seals 17B and 18B due to bend of the one end thereof can be prevented by means of fitting and engaging of the hole 28 provided in the one end bottom surface of the tip seal grooves 14M and 15M, and the projection 29 provided on the one end back surface of the tip seals 17B and 18B.

Accordingly, the tip seals 17B and 18B are installed to the edge of the end side of the tip surfaces 14I and 15I, an installation area of the tip seals 17B and 18B is enlarged, thereby gas leak from the tip surfaces is decreased, and improvement in efficiency and in performance of the so-called stepped wrap scroll compressor 1 can be achieved. Particularly, a performance improvement effect under a condition where a suction pressure is high at the time of low rotation is remarkable, and further compactness in size of the stepped wrap scroll compressor 1 can be achieved.

In addition, even if the tip seals 17B and 18B are installed extending to the end as described above, a bite breakage accident etc. due to an extracted state of the end can be reliably prevented.

Furthermore, an extracted state prevention means can be configured with the projection 29 and the hole 28 in the vertical direction that are respectively provided on the back surface of the tip seals 17B and 18B and in the bottom surface of the tip seal grooves 14M and 15M, they can be simply processed, and thus mass production can be sufficiently secured.

Furthermore, the projection 29 of the tip seal 17B and 18B sides is made as the cylindrical projection 29, and the hole 28 of the tip seal groove 14M and 15M sides in which the projection 29 is fitted and engaged is made as the cylindrical hole 28. Therefore, an extracted state of the tip seals 17B and 18B due to bend of the one end thereof can be prevented by means of catch of the cylindrical projection 29 in the cylindrical hole 28 that are fitted in each other, and installation and processing of the projection 29 and the hole 28 that are respectively provided on the tip seals 17B and 18B and in the tip seal grooves 14M and 15M can be made easy to perform.

That is, although there is no particular problem in molding the projection 29 on the tip seals 17B and 18B generally made of resin, the hole 28 provided in the tip seal grooves 14M and 15M of a metal scroll needs to be machined (cut), and it is effective in making processing easier that the hole 28 is made as the cylindrical one. Accordingly, even if the hole 28 is provided in the tip seal grooves 14M and 15M, processing is not particularly complicated, and the hole 28 can be simply processed as an extension of machining of the tip seal grooves 14M and 15M.

In addition, the cylindrical projection 29 and the cylindrical hole 28 are made as the projection 29 and the hole 28 respectively having a diameter the same as the width dimension of the tip seals 17B and 18B, and a diameter the same as the groove width dimension of the tip seal grooves 14M and 15M. Therefore, fitting of the tip seals 17B and 18B in the tip seal grooves 14M and 15M can be carried out substantially similarly to fitting of a tip seal without a projection and a tip seal groove without a hole, and the hole 28 provided in the tip seal grooves 14M and 15M can be processed by the end mill with which the tip seal grooves 14M and 15M are cut at the same time of groove processing. Accordingly, even if the projection 29 and the hole 28 are respectively provided on the tip seals 17B and 18B and in the tip seal grooves 14M and 15M, attachment of the tip seals 17B and 18B, and processing of the fixed scroll 14 and the orbiting scroll 15 are not particularly complicated, and processing of both scrolls 14 and 15 can be simplified.

Furthermore, in the above-described tip seal grooves 14M and 15M being cut by the end mill, the end mill is moved in a depth direction of the hole 28 at a position of the hole 28 formed in a groove bottom surface, thereby the tip seal grooves 14M and 15M and the hole 28 are simultaneously processed by the same end mill. Therefore, when the end of the tip seals 17B and 18B become in a cantilever state by a revolution in an orbiting manner of the orbiting scroll 15, processing of the tip seal grooves 14M and 15M including the hole 28 that prevents an extracted state due to bend of the end can be simultaneously performed only by using the same end mill, and moving the end mill in the depth direction of the hole 28 at a hole position. Accordingly, the tip seal grooves 14M and 15M including the hole 28 can be efficiently processed, and reduction in productivity due to perforating the hole 28 can be suppressed to the minimum.

Second Embodiment

Figure 4:
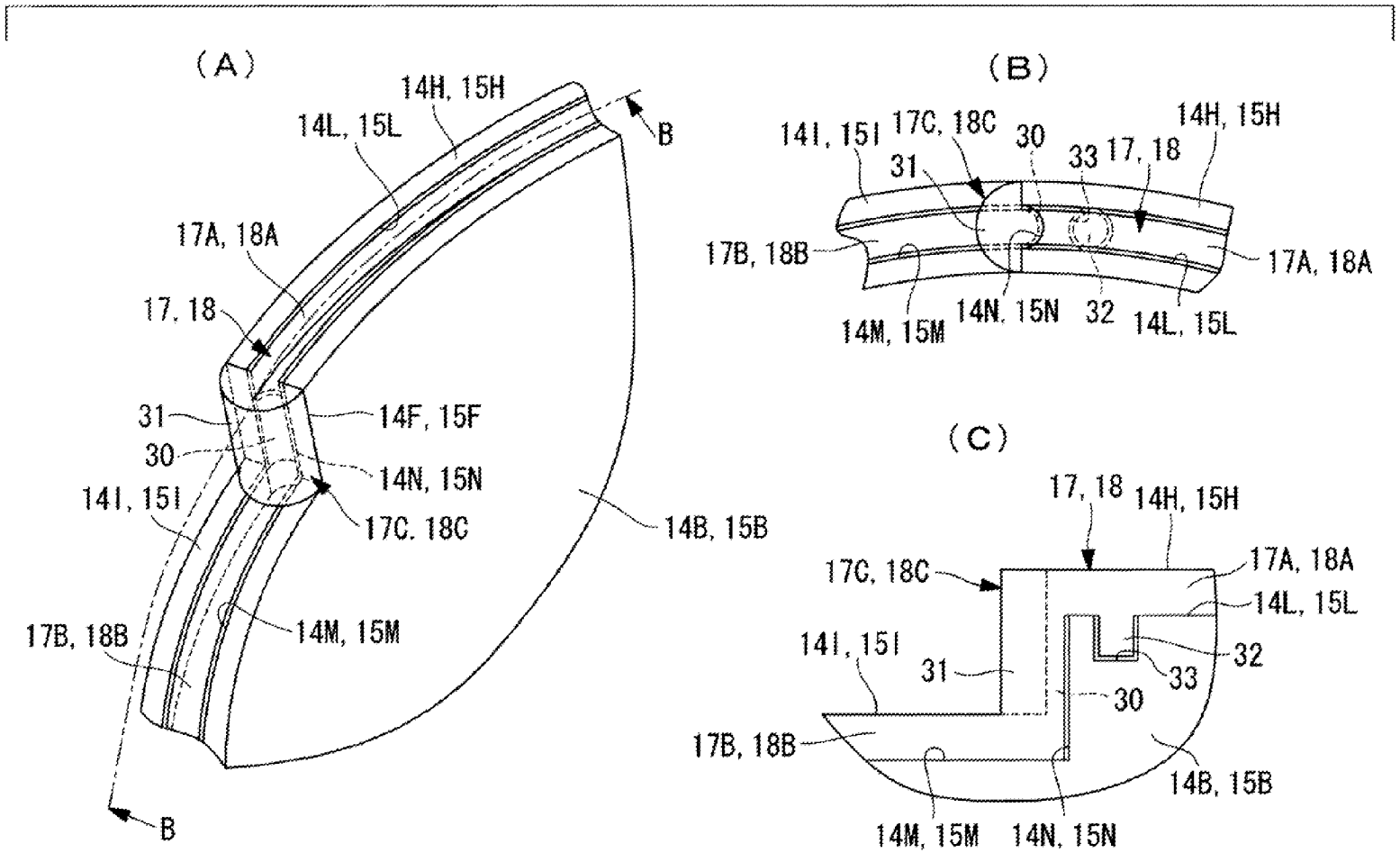
FIG. 4A is an enlarged perspective view of the vicinity of a step of a tip surface of a spiral wrap of a fixed and an orbiting scrolls pertaining to a second embodiment of the present invention.
FIG. 4B is a plan view thereof.
FIG. 4C is a cross-sectional view taken along a line B-B of FIG. 4A.

Next, a second embodiment of the present invention will be described using FIGS. 4A, 4B, and 4C.

The embodiment is different from the above-described first embodiment in a point where the tip seals 17A and 18A, and 17B and 18B that are provided on the higher tip surfaces 14H and 15H and the lower tip surfaces 14I and 15I are integrated to be as the integrated tip seals 17 and 18. Since the other points excluding the following are similar to in the first embodiment, description of the points will be omitted.

In the embodiment, the tip seals 17A and 18A, and 17B and 18B that are installed on the higher tip surfaces 14H and 15H and the lower tip surfaces 14I and 15I of the spiral wraps 14B and 15B are made as the crank-shaped integrated tip seals 17 and 18 that have been integrated through connection portions 17C and 18C over the steps 14F and 15F.

In addition, the tip seal grooves 14L and 15L, and 14M and 15M that are provided in the higher tip surfaces 14H and 15H and the lower tip surfaces 14I and 15I in order to fit and install the integrated tip seals 17 and 18 are also made as the tip seal grooves continuous through step portion tip seal grooves 14N and 15N over the steps 14F and 15F. The step portion tip seal grooves 14N and 15N are made as tip seal grooves having a semi-circular cross section with a diameter equal to the groove width dimension of the tip seal grooves 14L and 15L, and 14M and 15M that are provided on the tip surface side, and in the tip seal grooves 14L and 15L, and 14M and 15M of the tip surface side being cut by an end mill, the tip seal grooves 14N and 15N are configured to be able to be simultaneously cut by the end mill.

Meanwhile, the connection portions 17C and 18C of the integrated tip seals 17 and 18 are configured such that an inner surface side along the steps 14F and 15F is made as a fitting portion 30 having a semi-circular cross section with a diameter equal to the width dimension of the tip seals 17A and 18A, and 17B and 18B so as to be fitted and installed in the step portion tip seal grooves 14N and 15N having the semi-circular cross-sectional shape, and that an outer surface side is made as a step tip surface 31 having a semi-circular cross section with a diameter equal to a tooth thickness dimension of the spiral wraps 14B and 15B, and that the inner surface side and the outer surface side are integrally molded.

In addition, a projection 32 extending in the vertical direction from a back surface of the tip seals 17A and 18A is provided at a position near the steps 14F and 15F of the tip seals 17A and 18A corresponding to the higher tip surfaces 14H and 15H of the integrated tip seals 17 and 18. In addition, a hole 33 in which the projection 32 is fitted and engaged is formed in a bottom surface located at a position near the steps 14F and 15F of the tip seal grooves 14L and 15L of the higher tip surface 14H and 15H sides in which the integrated tip seals 17 and 18 are fitted. By means of fitting and engaging of the projection 32 and the hole 33, a force in a tip seal groove direction applied to the tip seals 17A and 18A is received, and the tip seals 17A and 18A are blocked from moving in the groove direction.

The above-described projection 32 and hole 33 are, similarly to the projection 29 and the hole 28 of the above-described first embodiment, made as the cylindrical projection 32 and hole 33 respectively having a diameter the same as the width dimension of the tip seals 17A and 18A, and a diameter the same as the groove width dimension of the tip seal grooves 14L and 15L.

Note that in the embodiment, it is not prevented to provide the projection 29 and the hole 28 similar to in the first embodiment on the back surface of the outer circumferential end of the tip seals 17B and 18B installed on the lower tip surface 14I and 15I sides, and in the outer circumferential end of the bottom surface of the tip seal grooves 14M and 15M in which the tip seals 17B and 18B are fitted, and the projection 29 and the hole 28 may be provided together.

In the embodiment, the tip seal grooves 14L and 15L, and 14M and 15M that are provided in the higher and lower tip surfaces 14H and 15H, and 14I and 15I of the spiral wraps 14B and 15B are made continuous tip seal grooves through the step portion tip seal grooves 14N and 15N over the steps 14F and 15F. In addition, the crank-shaped integrated tip seals 17 and 18 that have been integrated through the connection portions 17C and 18C over the steps 14F and 15F are fitted and installed in the continuous tip seal groove. Furthermore, the projection 32 extending in the vertical direction from the back surface of the tip seals 17A and 18A is provided at the position near the steps 14F and 15F of the tip seals 17A and 18A corresponding to the higher tip surfaces 14H and 15H of the integrated tip seals 17 and 18, and the hole 33 in which the projection 32 is fitted and engaged is formed in the bottom surface located at the position near the steps 14L and 15L of the tip seal grooves 14L and 15L in which the tip seals 17A and 18A are fitted.

As described above, the crank-shaped integrated tip seals 17 and 18 that have been integrated through the connection portions 17C and 18C over the steps 14F and 15F are fitted and installed in the tip seal grooves 14L and 15L, and 14M and 15M that are continuous through the step portion tip seal grooves 14N and 15N over the steps 14F and 15F. As a result, the integrated tip seals 17 and 18 can be installed so as to cover a whole area of the inner circumferential side and the outer circumferential side that sandwiches the steps 14F and 15F of the tip surfaces 14H and 15H, and 14I and 15I of the spiral wraps 14B and 15B.

In addition, the outer circumferential end portion of the tip seals 17B and 18B that are fitted and installed in the tip seal grooves 14M and 15M of the lower tip surfaces 14I and 15I, the outer circumferential end portion repeating contact and non-contact with the bottom lands 14K and 15K of the other scrolls 14 and 15, is supported by the connection portions 17C and 18C over the steps 14F and 15F, and thereby an extracted state of the tip seals 17B and 18B due to bend of an end portion thereof can be prevented. Furthermore, the force in the tip seal groove direction applied to the tip seals 17A and 18A that are fitted and installed in the tip seal grooves 14L and 15L of the higher tip surfaces 14H and 15H is received by means of fitting and engaging of the projection 32 and the hole 33 that are respectively provided at the position near the steps 14F and 15F of the higher tip surfaces 14H and 15H, and in the bottom surface located at the position near the steps 14F and 15F of the tip seal grooves 14L and 15L, and movement of the tip seals 17A and 18A can be blocked.

Therefore, the integrated tip seals 17 and 18 are installed in the whole area of the inner circumferential side and the outer circumferential side that sandwiches the steps 14F and 15F of the tip surfaces 14H and 15H, and 14I and 15I of the spiral wraps 14B and 15B, an installation area of the integrated tip seals 17 and 18 is enlarged, thereby gas leak from the tip surfaces of the spiral wraps 14B and 15B is decreased, and thus improvement in efficiency and in performance of the so-called stepped wrap scroll compressor 1 can be achieved. Particularly, a performance improvement effect under a condition where a suction pressure is high at the time of low rotation can be increased, and further compactness in size of the stepped wrap scroll compressor 1 can be achieved.

In addition, by installing the integrated tip seals 17 and 18 as described above, can be prevented a bite breakage accident etc. due to an extracted state of an outer circumferential end portion of the tip seals 17B and 18B installed in the tip seal grooves 14M and 15M of the lower tip surfaces 14I and 15I. In addition, can be prevented a breakage accident etc. of the connection portions 17C and 18C of the integrated tip seals 17 and 18 due to the force in the groove direction that is applied to the tip seals 17A and 18A that are fitted in the tip seal grooves 14L and 15L of the higher tip surfaces 14H and 15H.

In addition, in this case, an extracted state of the tip seals 17B and 18B of the lower tip surface 14I and 15I sides can be supported by the connection portions 17C and 18C of the integrated tip seals 17 and 18. Therefore, it is not necessary to provide a fitting portion other than the tip seals 17A and 18A provided on the higher tip surface 14H and 15H sides, and the projection 32 and the hole 33 in the vertical direction that are provided in the tip seal grooves 14L and 15L, they can be simply processed, and thus mass production can be sufficiently secured.

In addition, the step portion tip seal grooves 14N and 15N over the steps 14F and 15F are made as the tip seal grooves having the semi-circular cross section with the diameter equal to the groove width dimension of the tip seal grooves 14L and 15L, and 14M and 15M that are provided on the tip surface side. Therefore, the step portion tip seal grooves 14N and 15N can be cut simultaneously at the time of processing of the tip seal grooves 14L and 15L, and 14M and 15M of the tip surface side using the end mill with which the tip seal grooves 14L and 15L, and 14M and 15M of the tip surface side are cut. Accordingly, even if the tip seal grooves 14L and 15L, and 14M and 15M, and the step portion tip seal grooves 14N and 15N are provided over the steps 14F and 15F, processing of the fixed scroll 14 and the orbiting scroll 15 is not particularly complicated, and processing of both the scrolls 14 and 15 can be simplified.

In addition, at the connection portions 17C and 18C of the integrated tip seals 17 and 18, provided is the fitting portion 30 having the semi-circular cross section with a diameter equal to the width dimension of the integrated tip seals 17 and 18 fitted in the step portion tip seal grooves 14N and 15N having the semi-circular cross section. Therefore, the fitting portion 30 is fitted in the step portion tip seal grooves 14N and 15N having the semi-circular cross section, and thereby the integrated tip seals 17 and 18 can be stably fitted and installed with good settlement in the continuous tip seal grooves 14L and 15L, and 14M and 15M that are provided in the higher and lower tip surfaces 14H and 15H, and 14I and 15I. In addition, an extracted state of the tip seals 17B and 18B due to bend thereof fitted in the lower tip surfaces 14I and 15I can be prevented by using the connection portions 17C and 18C as a support. Accordingly, by means of the integrated tip seals 17 and 18 that are stably fitted and installed with good settlement, gas leak near the steps 14F and 15F is sufficiently reduced, and performance of the stepped wrap scroll compressor 1 can be much more improved.

Furthermore, the step tip surface 31 having a semi-circular cross section with a diameter equal to a tooth thickness dimension of the spiral wraps 14B and 15B is integrally molded at the connection portions 17C and 18C of the integrated tip seals 17 and 18. Therefore, a mesh surface between the steps 14G and 15G that are provided at the bottom lands 14E and 15E of the spiral wraps 14B and 15B of the other scrolls 14 and 15 can be sealed by means of the step tip surface 31 having the semi-circular cross section. Accordingly, in the so-called stepped wrap scroll compressor 1, gas leak from a step mesh surface regarded as gas leak being most likely to occur is reduced, and performance of the stepped wrap scroll compressor 1 can be much more improved.

In addition, in the tip seal grooves 14L and 15L, and 14M and 15M that are provided in the higher and lower tip surfaces 14H and 15H, and 14I and 15I of the spiral wraps 14B and 15B being cut by an end mill, the step portion tip seal grooves 14N and 15N over the steps 14F and 15F can be simultaneously cut using the same end mill as an extension of the cutting of the tip seal grooves 14L and 15L, and 14M and 15M. As a result, even when the integrated tip seals 17 and 18 are installed, the step portion tip seal grooves 14N and 15N having a semi-circular cross section can be efficiently processed in the steps 14F and 15F of the fixed scroll 14 and the orbiting scroll 15. Accordingly, reduction in productivity due to providing the tip seal grooves 14N and 15N in the steps 14F and 15F can be suppressed to the minimum.

Third Embodiment

Next, a third embodiment of the present invention will be described using FIGS. 5A and 5B.

The embodiment is different from the above-described first and second embodiments in a point where a projection 34 and a hole 35 are respectively provided on the tip seals 17A and 18A that are provided on the higher tip surfaces 14H and 15H, and in an outer circumferential end of the tip seal grooves 14L and 15L. Since the other points are similar to in the first and second embodiments, description thereof will be omitted.

Figure 5:
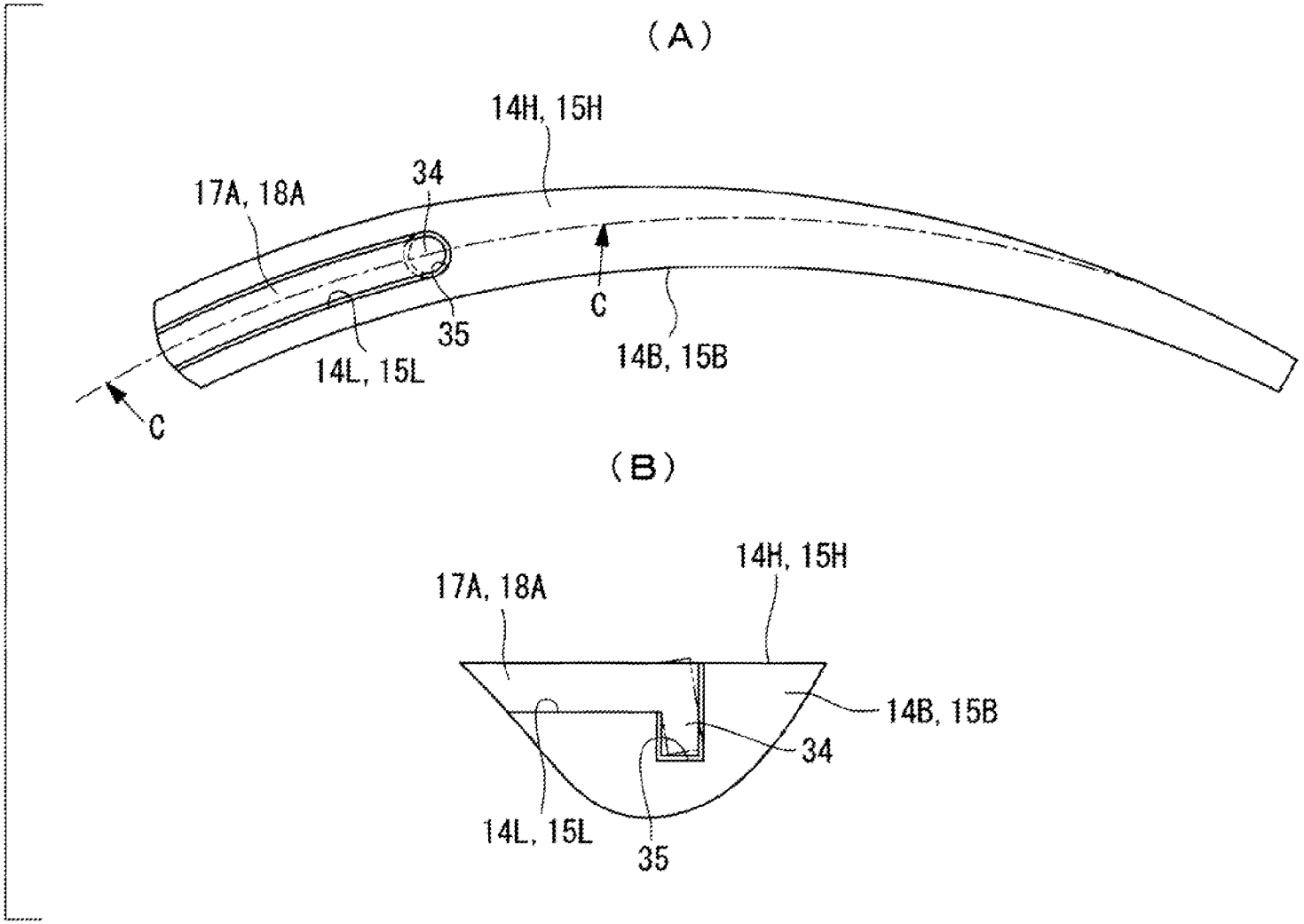
FIG. 5A is an enlarged plan view of an outer circumferential end of a higher tip surface of a spiral wrap of a fixed and an orbiting scrolls pertaining to a third embodiment of the present invention.
FIG. 5B is a cross-sectional view taken along a line C-C of FIG. 5A.

In the embodiment, as shown in FIGS. 5A and 5B, the cylindrical hole 35 with a diameter equal to the groove width dimension of the tip seal grooves 14L and 15L is formed in the vertical direction in the outer circumferential end of a bottom surface of the tip seal grooves 14L and 15L that are provided in the higher tip surfaces 14H and 15H of the spiral wraps 14B and 15B. Meanwhile, the embodiment is configured such that the cylindrical projection 34 with a diameter equal to the width dimension of the tip seals 17A and 18A is provided projecting in the vertical direction on a back surface of the outer circumferential end of the tip seals 17A and 18A (the tip seals 17A and 18A of the integrated tip seals 17 and 18 are included) that are fitted and installed in the tip seal grooves 14L and 15L, and that the projection 34 and the hole 35 are fitted and engaged in each other.

In the tip seals 17A and 18A provided on the higher tip surfaces 14H and 15H of the spiral wraps 14B and 15B, an outer diameter of the end plates 14A and 15A of the fixed scroll 14 and the orbiting scroll 15 are made small for achieving compactness in size of the stepped wrap scroll compressor 1, and thus the outer circumferential end of the tip seals 17A and 18A repeats contact and separation with/from the lower bottom lands 14J and 15J of an outer circumference of the end plates 14A and 15A due to a revolution in an orbiting manner of the orbiting scroll 15. Therefore, when the tip seals 17A and 18A are installed close to the outer circumferential end of the higher tip surfaces 14H and 15H, the outer circumferential end of the tip seals 17A and 18A becomes in a cantilever state due to the above-described contact and separation, but as shown in FIG. 5B, an extracted state of the tip seals 17A and 18A due to bend of the outer circumferential end thereof can be prevented by means of fitting and engaging of the projection 34 and the hole 35.

Accordingly, the tip seals 17A and 18A are installed close to the outer circumferential end of the higher tip surfaces 14H and 15H of the spiral wraps 14B and 15B of the fixed scroll 14 and/or the orbiting scroll 15, an installation area of the tip seals 17A and 18A is enlarged, thereby gas leak from the end tip surfaces is further decreased, and improvement in efficiency and in performance of the stepped wrap scroll compressor 1 can be achieved. In addition, even if the tip seals 17A and 18A provided on the higher tip surfaces 14H and 15H of the spiral wraps 14B and 15B are installed extending as described above, a bite breakage accident etc. due to an extracted state of the end can be reliably prevented. Note that it is needless to say that an effect of the embodiment can be more improved by using the embodiment together with the first and second embodiments.

Fourth Embodiment

Next, a fourth embodiment of the present invention will be described using FIGS. 6A and 6B.

The embodiment is different from the above-described first to third embodiments in a point where a projection 36 and a hole 37 are respectively provided on the tip seal 18B that is provided on the lower tip surface 15I of the spiral wrap 15B of the orbiting scroll 15, and in an inner circumferential end of the tip seal groove 15M. Since the other points are similar to in the first to third embodiments, description thereof will be omitted.

Figure 6:
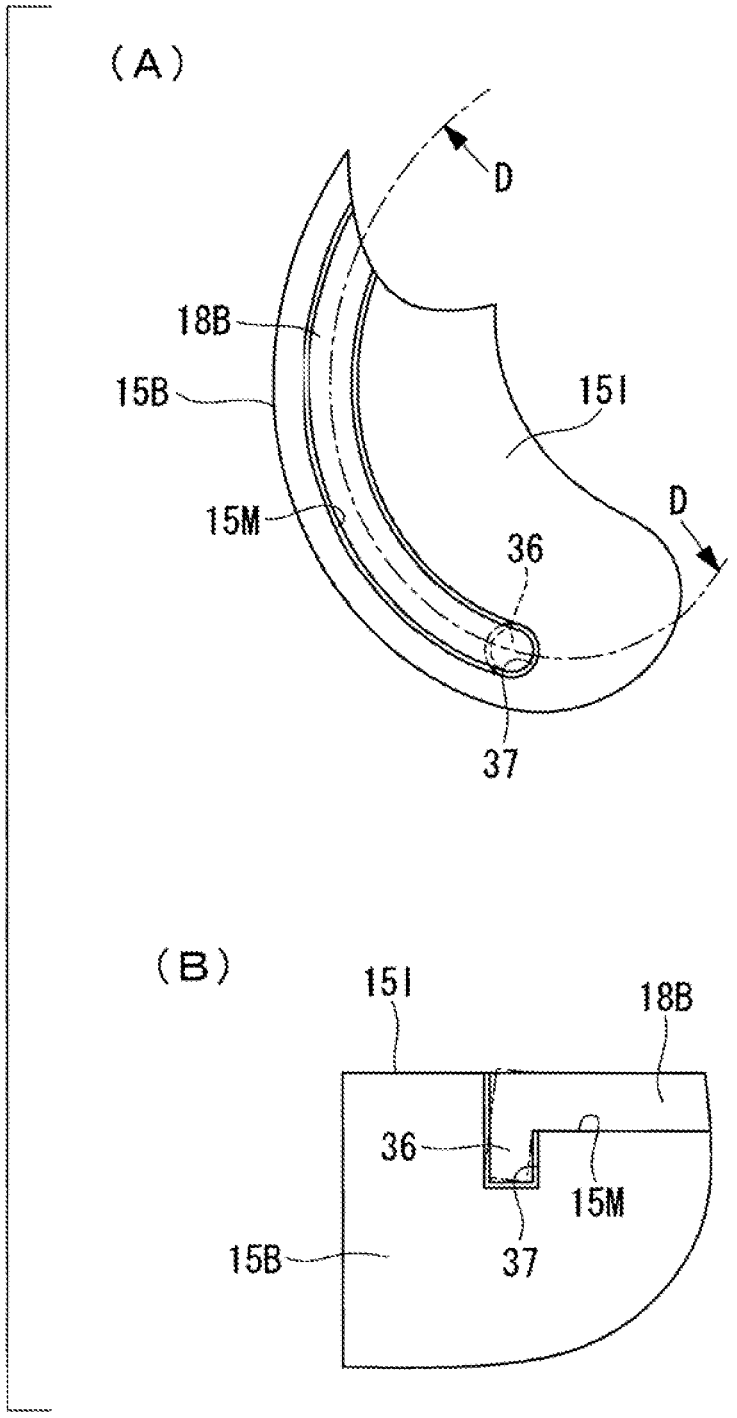
FIG. 6A is an enlarged plan view of an inner circumferential end of a lower tip surface of a spiral wrap of an orbiting scrolls pertaining to a fourth embodiment of the present invention.
FIG. 6B is a cross-sectional view taken along a line D-D of FIG. 6A.

In the embodiment, as shown in FIGS. 6A and 6B, the cylindrical hole 37 with a diameter equal to the groove width dimension of the tip seal groove 15M is formed in the vertical direction in the inner circumferential end of a bottom surface of the tip seal groove 15M provided in the lower tip surface 15I of the spiral wrap 15B of the orbiting scroll 15. In addition, the cylindrical projection 36 with a diameter equal to the width dimension of the tip seal 18B is provided projecting in the vertical direction on the back surface of the inner circumferential end of the tip seal 18B (the tip seal 18B of the integrated tip seal 18 is included) fitted and installed in the tip seal groove 15M, and the projection 36 and the hole 37 are fitted and engaged in each other.

Since the discharge port 14C is provided in the center portion of the fixed scroll 14, the inner circumferential end of the tip seal 18B provided on the lower tip surface 15I of the spiral wrap 15B of the orbiting scroll 15 repeats contact and non-contact with the higher bottom land 14K of the fixed scroll 14, in the tip surface 15I crossing the discharge port 14C. Therefore, when the tip seal 18B is installed close to an inner circumferential end of the lower tip surface 15I, the inner circumferential end of the tip seal 18B becomes in a cantilever state due to the above-described contact and non-contact, but as shown in FIG. 6B, an extracted state of the tip seal 18B due to bend of the inner circumferential end thereof can be prevented by means of fitting and engaging of the projection 36 and the hole 37.

Accordingly, the tip seal 18B is installed to the edge of the inner circumferential end of the lower tip surface 15I of the spiral wrap 15B of the orbiting scroll 15, an installation area of the tip seal 18B is enlarged, thereby gas leak from the end tip surface is decreased, and improvement in efficiency and in performance of the stepped wrap scroll compressor 1 can be achieved. In addition, even if the tip seal 18B provided on the lower tip surface 15I of the spiral wrap 15B of the orbiting scroll 15 is installed extending as described above, a bite breakage accident etc. due to an extracted state of the end of the tip seal 18B can be reliably prevented.

It is to be noted that the present invention is not limited to inventions pertaining to the above-described embodiments, and it can be appropriately modified without departing from the scope of the invention. For example, although in the above-described embodiment, the example has been described where the present invention is applied to the open-type scroll compressor 1 driven by external power, it goes without saying that the present invention is applicable also to a sealed-type scroll compressor having a motor incorporated therein.

In addition, although the pin-ring type rotation blocking mechanism has been described as the rotation blocking mechanism 19, other rotation blocking mechanisms, such as an Oldham-ring type rotation blocking mechanism, may also be employed, further, a driven crank mechanism is not limited to the oscillation system of the above-described embodiments, either, and an other driven crank mechanism may be used.

REFERENCE SIGNS LIST

1 Scroll compressor
14 Fixed scroll
14B Fixed spiral wrap
14D Tip surface
14E Bottom land
14F and 14G Step
14H Higher tip surface
14I Lower tip surface
14J Lower bottom land
14K Higher bottom land
14L and 14M Tip seal groove
14N Step portion tip seal groove
15 Orbiting scroll
15B Orbiting spiral wrap
15D Tip surface
15E Bottom land
15F and 15G Step
15H Higher tip surface
15I Lower tip surface
15J Lower bottom land
15K Higher bottom land
15L and 15M Tip seal groove
15N Step portion tip seal groove
17 and 18 Integrated tip seal (Tip seal)
17A, 17B, 18A, and 18B Tip seal
17C and 18C Connection portion
28, 33, 35, and 37 Hole (Cylindrical hole)
29, 32, 34, and 36 Projection (Cylindrical projection)
30 Fitting portion
31 Step tip surface

The invention claimed is:

1. A scroll compressor comprising: a fixed scroll and an orbiting scroll each of which is provided with a step formed in each of a tip surface and a bottom land of a spiral wrap thereof, each of the steps being at a position along a spiral direction of the tip surface or the bottom land, and a wrap height of an outer circumferential side of the spiral relative to the step wrap being higher than a wrap height of an inner circumferential side thereof relative to the step; a tip seal groove provided in a higher tip surface and a lower tip surface of the spiral wrap of each of the fixed scroll and the orbiting scroll; and a tip seal fitted in each of the tip seal grooves of the fixed scroll and the orbiting scroll, wherein the outer circumferential end of the tip seal fitted on the higher tip surface of the fixed scroll and the orbiting scroll is repeatedly situated in a non-contact state in which said outer circumferential end moves beyond an outer end of the bottom land of the corresponding scroll and thereby said outer circumferential end of the tip seal does not come into contact with said bottom land, and in a contact state in which said outer circumferential end moves beyond said outer end of the bottom land so that said outer circumferential end of the tip seal again comes into contact with said bottom land, wherein said outer circumferential end of the tip seal becomes a cantilever state in the non-contact state, wherein said outer circumferential end of the tip seal is provided with a projection extending in a vertical direction from a back surface of the tip seal, wherein the tip seal groove is provided with a hole in which the projection is fitted and engaged at an outer circumferential end of the corresponding bottom surface of the tip seal groove in which the tip seal is fitted so that said outer circumferential end of the tip seal is prevented from moving in the axial direction of the compressor and thereby from being detached from the tip seal groove, wherein the outer circumferential end of the tip seal fitted on the higher tip surface faces and comes into contact with, in the circumferential direction of the fixed scroll, the outer circumferential end wall of the corresponding tip seal groove.

2. A scroll compressor comprising: a fixed scroll and an orbiting scroll each of which is provided with a step formed in each of a tip surface and a bottom land of a spiral wrap thereof, each of the steps being at a position along a spiral direction of the tip surface or the bottom land, and a wrap height of an outer circumferential side of the spiral relative to the step wrap being higher than a wrap height of an inner circumferential side thereof relative to the step; a tip seal groove provided in a higher tip surface and a lower tip surface of the spiral wrap of each of the fixed scroll and the orbiting scroll; and a tip seal fitted in each of the tip seal grooves of the fixed scroll and the orbiting scroll, wherein the tip seal groove provided in the higher and the lower tip surfaces of the spiral wrap is configured as a continuous tip seal groove over the step, and a crank-shaped integrated tip seal integrated through a connection portion over the step is fitted in the tip seal groove, wherein a portion corresponding to the higher tip surface of the integrated tip seal is provided with a first projection extending in a compressor-axis direction from a back surface of the integrated tip seal, the first projection is provided near the step, and the seal groove is provided with a first hole in which the projection is fitted and engaged, the first hole is provided at a bottom surface of a position near the step in the tip seal groove of the higher tip surface in which the integrated tip seal is fitted, wherein the outer circumferential end of said portion of the integrated tip seal, which corresponds to the higher tip surface, of the fixed scroll and the orbiting scroll is repeatedly situated in a non-contract state in which said outer circumferential end moves beyond an outer end of the bottom land of the corresponding scroll and thereby said outer circumferential end of the tip seal does not come into contact with said bottom land, and in a contact state in which said outer circumferential end moves beyond said outer end of the bottom land so that said outer circumferential end of the tip seal again comes into contact with said bottom land, wherein said outer circumferential end of the tip seal becomes a cantilever state in the non-contact state, wherein a second projection extending in a vertical direction from a back surface of the tip seal is provided at said outer circumferential end of the tip seal fitted on the higher tip surface of the spiral wrap of the fixed scroll and/or the orbiting scroll, and a second hole is provided in the bottom surface near the outer circumferential end wall of the corresponding tip seal groove so that said outer circumferential end of the tip seal is prevented from moving in the axial direction of the compressor and thereby from being detached from the tip seal groove, and wherein the outer circumferential end of the tip seal fitted on the higher tip surface faces and comes into contact with, in the circumferential direction of the fixed scroll, the outer circumferential end wall of the corresponding tip seal groove.

3. The scroll compressor according to claim 2, wherein the tip seal groove over the step is made as a step portion tip seal groove having a semi-circular cross section with a diameter equal to a groove width of the tip seal groove provided on the tip surface.

4. The scroll compressor according to claim 3, wherein a fitting portion having a semi-circular cross section with a diameter equal to a width of the integrated tip seal fitted in the step portion tip seal groove is provided at the connection portion of the integrated tip seal.

5. The scroll compressor according to claim 2, wherein a step tip surface having a semi-circular cross section with a diameter equal to a thickness of the spiral wrap is integrally molded at the connection portion of the integrated tip seal.

6. The scroll compressor according to claim 1, wherein the projection of the tip seal is formed as a cylindrical projection, and the hole of the tip seal groove in which the projection is fitted and engaged is formed as a cylindrical hole.

7. The scroll compressor according to claim 6, wherein the cylindrical projection and the cylindrical hole are formed as a projection with the diameter as the width of the tip seal, and a hole with the same diameter as the groove width of the tip seal groove, respectively.

8. A scroll compressor comprising:

a fixed scroll and an orbiting scroll each of which is provided with a step formed in each of a tip surface and a bottom land of a spiral wrap thereof, each of the steps being at a position along a spiral direction of the tip surface or the bottom land, and a wrap height of an outer circumferential side of the spiral relative to the step wrap being higher than a wrap height of an inner circumferential side thereof relative to the step; a tip seal groove provided in a higher tip surface and a lower tip surface of the spiral wrap of each of the fixed scroll and the orbiting scroll; and a tip seal fitted in each of the tip seal grooves of the fixed scroll and the orbiting scroll, wherein the outer circumferential end of the tip seal fitted on the lower tip surface of the fixed scroll and the orbiting scroll is repeatedly situated in a non-contact state in which said outer circumferential end moves beyond said step formed in the bottom land of the corresponding scroll and thereby said outer circumferential end of the tip seal does not come into contact with said bottom land, and in a contact state in which said outer circumferential end moves beyond said step formed in the bottom land so that said outer circumferential end of the tip seal again comes into contact with said bottom land, wherein said outer circumferential end of the tip seal becomes a cantilever state in the non-contact state, wherein said outer circumferential end of the tip seal is provided with a projection extending in a compressor-axis direction from a back surface of the tip seal, wherein the tip seal groove is provided with a hole in which the projection is fitted and engaged at an outer circumferential end of the tip seal groove provided in the lower tip surface so that said outer circumferential end of the tip seal is prevented from moving in the axial direction of the compressor and thereby from being detached from the tip seal groove, wherein the outer circumferential end of the tip seal fitted on the lower tip surface faces and comes into contact with, in the circumferential direction of the fixed scroll, the outer circumferential end wall of the corresponding tip seal groove.

9. A scroll compressor comprising: a fixed scroll and an orbiting scroll each of which is provided with a step formed in each of a tip surface and a bottom land of a spiral wrap thereof, each of the steps being at a position along a spiral direction of the tip surface or the bottom land, and a wrap height of an outer circumferential side of the spiral relative to the step wrap being higher than a wrap height of an inner circumferential side thereof relative to the step; a tip seal groove provided in a higher tip surface and a lower tip surface of the spiral wrap of each of the fixed scroll and the orbiting scroll; and a tip seal fitted in each of the tip seal grooves of the fixed scroll and the orbiting scroll, wherein the inner circumferential end of the tip seal fitted on the lower tip surface of the fixed scroll and the orbiting scroll is repeatedly situated in a non-contact state in which said inner circumferential end moves beyond an edge of a discharge hole provided in the bottom land of the corresponding scroll and thereby said inner circumferential end of the tip seal does not come into contact with said bottom land, and in a contact state in which said inner circumferential end moves beyond said edge of the discharge hole so that said inner circumferential end of the tip seal again comes into contact with said bottom land, wherein said inner circumferential end of the tip seal becomes a cantilever state in the non-contact state, wherein said inner circumferential end of the tip seal is provided with a projection extending in a compressor-axis direction from a back surface of the tip seal, wherein the tip seal groove is provided with a hole in which the projection is fitted and engaged at an inner circumferential end of the corresponding bottom surface of the tip seal groove in which the tip seal is fitted so that said inner circumferential end of the tip seal is prevented from moving in the axial direction of the compressor and thereby from being detached from the tip seal groove, and wherein the inner circumferential end of the tip seal fitted on the lower tip surface faces and comes into contact with, in the circumferential direction of the fixed scroll, the inner circumferential end wall of the corresponding tip seal groove.

10. A processing method of a scroll for processing the tip seal groove of the spiral wrap in the fixed scroll or the orbiting scroll of the scroll compressor according to claim 1, comprising processing the tip seal groove and the hole by moving an end mill in a depth direction of the hole at a position in the tip seal groove in which the hole is to be formed when the tip seal groove being cut by the same end mill.

11. The processing method of the scroll according to claim 10, wherein subsequent to the cutting of the tip seal groove of the tip surface, the step portion tip seal groove having a semi-circular cross section that is provided in the step is simultaneously cut using the same end mill.

12. The scroll compressor according to claim 2, wherein the first projection of the tip seal is formed as a cylindrical projection, and the first hole of the tip seal groove in which the first projection is fitted and engaged is formed as a cylindrical hole.

13. A scroll compressor comprising: a fixed scroll and an orbiting scroll each of which is provided with a step formed in each of a tip surface and a bottom land of a spiral wrap thereof, each of the steps being at a position along a spiral direction of the tip surface or the bottom land, and a wrap height of an outer circumferential side of the spiral relative to the step wrap being higher than a wrap height of an inner circumferential side thereof relative to the step; a tip seal groove provided in a higher tip surface and a lower tip surface of the spiral wrap of each of the fixed scroll and the orbiting scroll; and a tip seal fitted in each of the tip seal grooves of the fixed scroll and the orbiting scroll, wherein the tip seal groove provided in the higher and the lower tip surfaces of the spiral wrap is configured as a continuous tip seal groove over the step, and a crank-shaped integrated tip seal integrated through a connection portion over the step is fitted in the tip seal groove, wherein a portion corresponding to the higher tip surface of the integrated tip seal is provided with a first projection extending in a compressor-axis direction from a back surface of the integrated tip seal, the first projection is provided near the step, and the seal groove is provided with a first hole in which the projection is fitted and engaged, the first hole is provided at a bottom surface of a position near the step in the tip seal groove of the higher tip surface in which the integrated tip seal is fitted, wherein the outer circumferential end of a portion of the integrated tip seal, which corresponds to the lower tip surface, of the fixed scroll and the orbiting scroll is repeatedly situated in a non-contact state in which said outer circumferential end moves beyond said step formed in the bottom land of the corresponding scroll and thereby said outer circumferential end of the tip seal does not come into contact with said bottom land, and in a contact state in which said outer circumferential end moves beyond said step formed in the bottom land so that said outer circumferential end of the tip seal again comes into contact with said bottom land, wherein said outer circumferential end of the tip seal becomes a cantilever state in the non-contact state, wherein a second projection extending in a vertical direction from a back surface of the tip seal is provided at said outer circumferential end of the tip seal fitted on the lower tip surface of the spiral wrap, and a second hole is provided in a bottom surface of the outer circumferential end wall of the corresponding tip seal groove so that said outer circumferential end of the tip seal is prevented from moving in the axial direction of the compressor and thereby from being detached from the tip seal groove, and wherein the outer circumferential end of the tip seal fitted on the lower tip surface faces and comes into contact with, in the circumferential direction of the fixed scroll, the outer circumferential end wall of the corresponding tip seal groove.

14. A scroll compressor comprising:

a fixed scroll and an orbiting scroll each of which is provided with a step formed in each of a tip surface and a bottom land of a spiral wrap thereof, each of the steps being at a position along a spiral direction of the tip surface or the bottom land, and a wrap height of an outer circumferential side of the spiral relative to the step wrap being higher than a wrap height of an inner circumferential side thereof relative to the step; a tip seal groove provided in a higher tip surface and a lower tip surface of the spiral wrap of each of the fixed scroll and the orbiting, scroll; and a tip seal fitted in each of the tip seal grooves of the fixed scroll and the orbiting scroll, wherein the tip seal groove provided the higher and the lower tip surfaces of the spiral wrap is configured as a continuous tip seal groove over the step, and a crank-shaped integrated tip seal integrated through a connection portion over the step is fitted in the tip seal groove, wherein a portion corresponding to the higher tip surface of the integrated tip seal is provided with a first projection extending in a compressor-axis direction from a back surface of the integrated tip seal, the first projection is provided near the step, and the seal groove is provided with a first hole in which the projection is fitted and engaged, the first hole is provided at a bottom surface of a position near the step the tip seal groove of the higher tip surface in which the integrated tip seal is fitted, wherein the inner circumferential end of a portion of the integrated tip seal, which corresponds to the lower tip surface, of the fixed scroll and the orbiting scroll is repeatedly situated in a non-contact state in which said inner circumferential end moves beyond an edge of a discharge hole provided in the bottom land of the corresponding scroll and thereby said inner circumferential end of the tip seal does not come into contact with said bottom land, and in a contact state in which said inner circumferential end moves beyond said edge of the discharge hole so that said inner circumferential end of the tip seal again comes into contact with said bottom land, wherein said inner circumferential end of the tip seal becomes a cantilever state in the non-contact state, wherein a second projection extending in a vertical direction from a back surface of the tip seal is provided at said inner circumferential end of the tip seal fitted on the lower tip surface of the spiral wrap of the orbiting scroll, and a second hole is provided in a bottom surface of the inner circumferential end wall of the corresponding tip seal groove so that said inner circumferential end of the tip seal is prevented from moving in the axial direction of the compressor and thereby from being detached from the tip seal groove, and wherein the inner circumferential end of the tip seal fitted on the lower tip surface faces and comes into contact with, in the circumferential direction of the fixed scroll, the inner circumferential end wall of the corresponding top seal groove.

15. A processing method of a scroll for processing the tip seal groove of the spiral wrap in the fixed scroll or the orbiting scroll of the scroll compressor according to claim 2, comprising processing the tip seal groove and the first hole by an end mill by moving the end mill in a depth direction of the first hole at a position in the tip seal groove in which the first hole is to be formed when the tip seal groove being cut by the same end mill.

16. The scroll compressor according to claim 3, wherein a step tip surface having a semi-circular cross section with a diameter equal to a thickness of the spiral wrap is integrally molded at the connection portion of the integrated tip seal.

17. The scroll compressor according to claim 3, wherein the first projection of the tip seal is formed as a cylindrical projection, and the first hole of the tip seal groove in which the first projection is fitted and engaged is formed as a cylindrical hole.

18. The scroll compressor according to claim 3, wherein a third projection is provided near the outer circumferential end of the tip seal fitted on the lower tip surface of the spiral wrap, and a third hole is provided in a bottom surface near the outer circumferential end wall of the corresponding tip seal groove.

* * * * *